US011788357B2

(12) United States Patent
Nanayakkara et al.

(10) Patent No.: US 11,788,357 B2
(45) Date of Patent: Oct. 17, 2023

(54) USING SOLENOID CHARACTERISTICS FOR PERFORMANCE DIAGNOSTICS ON ROTARY STEERABLE SYSTEMS

(71) Applicant: Halliburton Energy Services, Inc., Houston, TX (US)

(72) Inventors: Ravi P. Nanayakkara, Kingwood, TX (US); Neelesh V. Deolalikar, Houston, TX (US); Larry DeLynn Chambers, Kingwood, TX (US); Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 225 days.

(21) Appl. No.: 17/294,271

(22) PCT Filed: Dec. 14, 2018

(86) PCT No.: PCT/US2018/065611
§ 371 (c)(1),
(2) Date: May 14, 2021

(87) PCT Pub. No.: WO2020/122930
PCT Pub. Date: Jun. 18, 2020

(65) Prior Publication Data

US 2022/0003043 A1 Jan. 6, 2022

(51) Int. Cl.
*E21B 7/06* (2006.01)
*E21B 34/08* (2006.01)
*E21B 47/06* (2012.01)

(52) U.S. Cl.
CPC ..... *E21B 7/06* (2013.01); *E21B 34/08* (2013.01); *E21B 47/06* (2013.01)

(58) Field of Classification Search
CPC . E21B 7/06; E21B 34/08; E21B 47/06; E21B 7/10; E21B 7/04
See application file for complete search history.

(56) References Cited

U.S. PATENT DOCUMENTS 5,794,718 A * 8/1998 Zollinger ..... E21B 4/145 175/73
8,763,725 B2 7/2014 Downton
(Continued)

OTHER PUBLICATIONS

International Preliminary Search Report issued in related PCT Application No. PCT/US2018/065611 dated Jun. 24, 2021, 9 pages.
(Continued)

*Primary Examiner* — Brad Harcourt
(74) *Attorney, Agent, or Firm* — Kilpatrick Townsend & Stockton LLP

(57) ABSTRACT

An extendable member diagnostic assembly determines performance of one or more components of a rotary steerable system. Based on the determined performance, an operation can be altered, such as a drilling operation. Performance may be based on measurements received from one or more sensors associated with components of the extendable member diagnostic assembly. For example, performance may be based on the time to transition a valve between states where the valve controls actuation of an extendable member, downhole temperature, downhole pressure or any other factors that affect performance of components that are used to perform the drilling operation. A controller receives the measurements from the one or more sensors and updates baseline parameters to determine an accurate performance. Using real time data to determine performance increases efficiency of an operation by eliminating unnecessary replacement of components and indicating that a downhole tool should be retrieved prior to failure.

20 Claims, 15 Drawing Sheets

(56) References Cited

U.S. PATENT DOCUMENTS

| | | | | |
|---|---|---|---|---|
| 10,422,184 | B1 * | 9/2019 | Feddema | E21B 7/062 |
| 2007/0119406 | A1 | 5/2007 | McDonald et al. | |
| 2011/0036632 | A1 | 2/2011 | Polynstev | |
| 2011/0162890 | A1 | 7/2011 | Radovan | |
| 2012/0160565 | A1 | 6/2012 | Downton et al. | |
| 2017/0074070 | A1 * | 3/2017 | Hay | E21B 21/08 |
| 2018/0258702 | A1 * | 9/2018 | Marson | E21B 44/005 |
| 2019/0301244 | A1 * | 10/2019 | Moore | E21B 47/024 |

OTHER PUBLICATIONS

International Search Report and Written Opinion issued in related PCT Application No. PCT/US2018/065611 dated Aug. 26, 2019, 12 pages.

* cited by examiner

USING SOLENOID CHARACTERISTICS FOR PERFORMANCE DIAGNOSTICS ON ROTARY STEERABLE SYSTEMS

CROSS-REFERENCE TO RELATED APPLICATION

The present application is a U.S. National Stage Application of International Application No. PCT/US2018/065611 filed Dec. 14, 2018, which is incorporated herein by reference in its entirety for all purposes.

FIELD OF THE DISCLOSURE

The present disclosure general relates to rotary steerable drilling systems and more particularly to downhole measured solenoid characteristics for failure and performance diagnostics of one or more downhole components.

BACKGROUND

Directional drilling is commonly used to drill any type of well profile where active control of the well bore trajectory is required to achieve the intended well profile. Many directional drilling systems and techniques are based on rotary steerable systems (RSS), which allow the drill string to rotate while changing the direction of the borehole. For example, a directional drilling operation may be conducted when the target pay zone cannot be reached from a land site vertically above it. Directional drilling operations involve varying or controlling the direction of drilling in a wellbore to direct the tool towards the desired target destination. Examples of directional drilling systems include point-the-bit rotary steerable drilling systems and push-the-bit rotary steerable drilling systems. Push-the-bit tools use extendable members on the outside of the downhole tool which press against the wellbore to deflect a drive shaft to tilt the drill bit axis toward the planning wellbore direction. Point-the-bit technologies comprise mechanical components that can apply a lateral directional force or side force against the wellbore to cause the direction of the bit to change relative to the rest of the tool. In many hydrocarbon drilling operations, it is advantageous to predict the wear and lifespan of a component of any downhole tool, for example, the components associated with the extendable members used for RSS as the replacement or failure of a component may be expensive and time consuming as the component may not be readily available at a site or the replacement of the component may require shipping the component or tool comprising the component off site. Reliable diagnostics are needed to predict the remaining usefulness, operation or integrity of a component in a downhole operation, such as, an extendable member and associated components of a RSS.

BRIEF DESCRIPTION OF THE DRAWINGS

For a detailed description of the embodiments of the invention, reference will now be made to the accompanying drawings in which.

DETAILED DESCRIPTION

Figure 1:
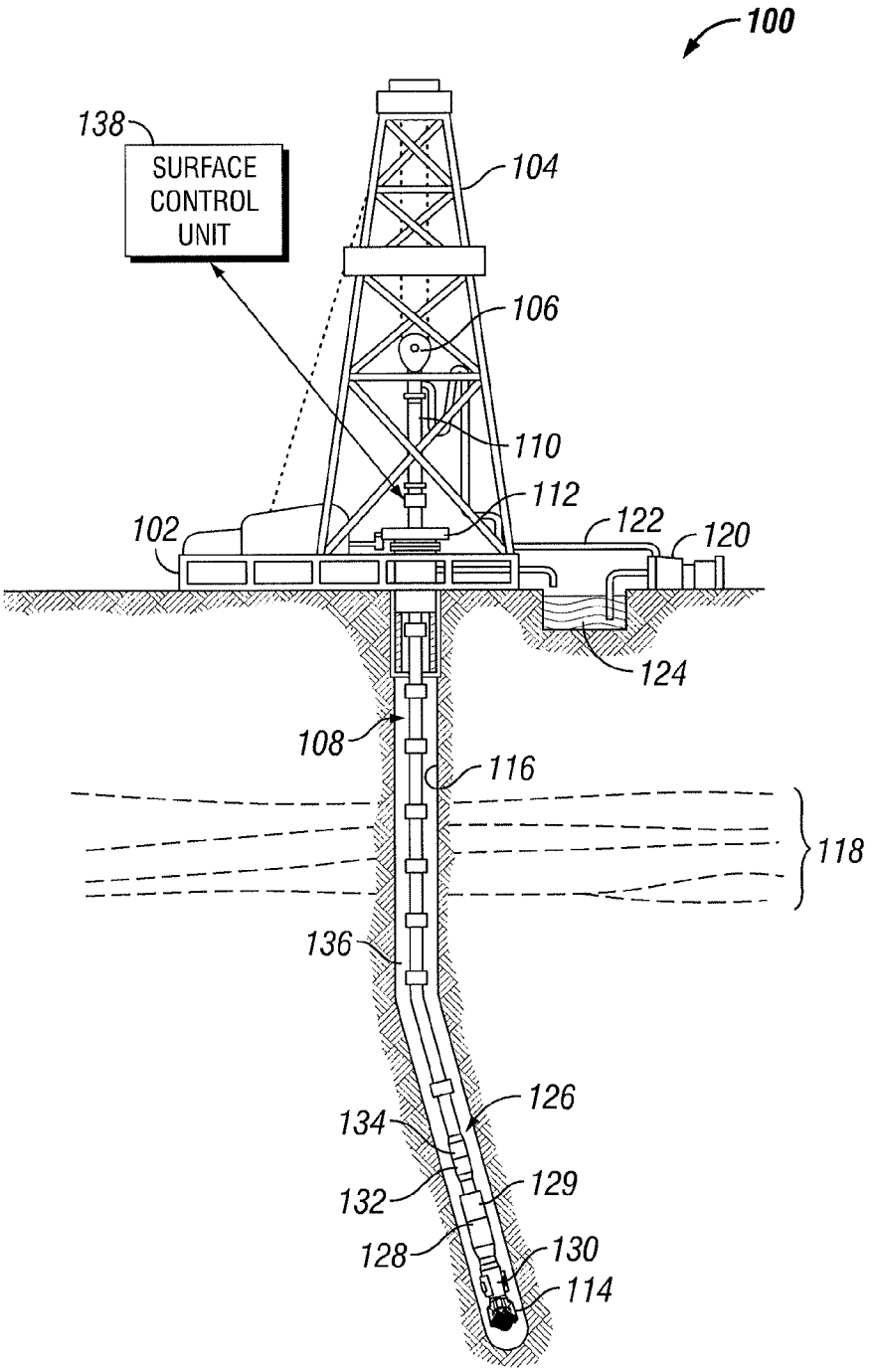
FIG. 1 depicts a schematic view of a directional drilling operation, according to one or more aspects of the present disclosure.

The present disclosure relates to directional drilling, such as a rotary steerable system (RSS), with an extendable member diagnostic assembly for determining and predicting failure of a component of the extendable member diagnostic assembly or any other component of the RSS and altering one or more operations based on one or more measurements associated with the extendable member diagnostic assembly, one or more other components, or both. Downhole tools and components may experience difference in behavior between one or more conditions at a surface environment as opposed to a downhole environment. The one or more conditions experienced by a downhole tool or component may comprise temperature, pressure, contact material (such as abrasive materials or fluids pumped downhole, well bore wall, formation type), velocity of contact with one or more contact materials, velocity (such as angular velocity), or any other condition or combination thereof. For example, a downhole tool or component may exhibit acceptable operational characteristics at the surface but once conveyed downhole the downhole tool or component when subjected to the one or more conditions downhole may not operate at acceptable operational characteristics or may fail completely. Typically, assumptions not based on actual performance of any given performance are made as to when to replace a downhole tool or manual adjustments are made at the surface based on the assumptions. Dynamic correction is not possible as several minutes may pass between the manual adjustment and implementation of the adjustment downhole.

Downhole diagnostics of the downhole tool or components provides for accurate determinations of deterioration in performance of the downhole tool or component which may be used to determine the remaining duration or time that the downhole tool or component will function with acceptable operational characteristics or to determine that one or more operations should be altered to prolong the usefulness of the downhole tool or component. For example, sourcing replacement downhole tools or components at a site may be expensive and a particular site may not have any allotted space for such replacements (such as at an offshore location). In some instances, a downhole tool or component may be pulled from use in an operation prematurely. For example, as downhole conditions and environments vary, a downhole tool or component may normally be replaced after a certain interval or specified condition occurs regardless of the actual operational fitness of the downhole tool or component. Such a premature replacement is costly as such downhole tools and components may be expensive and time-consuming to replace as well as such replacement may unnecessarily delay completion of an operation which also increases the overall costs of the operation. A downhole tool for a RSS that includes or comprises a extendable member diagnostic assembly may provide for ease in determination and accurate estimation of the deterioration or degradation in performance of a downhole tool or component during use downhole which allows for alteration of an operation to prolong or accommodate or account for the deterioration in performance, replacement of a downhole tool or component only when necessary and elimination of unwarranted replacement of downhole tools or components. Additionally, fewer sensors are required to determine the useful life span or performance of the downhole tool or components of the downhole which not only saves costs but also allows for additional components to be utilized in the same space or for a decrease in overall size of the downhole tool. For example, due to the harsh downhole environment and the operation of steering systems, sensors for monitoring operation of such steering systems are not typically placed directly on or at the steering system (such as extendable members or pads) as such placement leads to damage or loss of the sensor. By indirectly monitoring, for example, using a controller, the steering system or extendable pads and using a prediction model, the performance of any one or more components can be assessed and determinations made as to the expected performance or health of the steering system such as the actuation devices required to extend the extendable pads. In one or more embodiments, a faulty valve used for actuation of an extendable pad may be detected prior to actual failure of the valve. Additionally, by monitoring the performance of a valve, an operation can be extended as opening and closing times of the valve can be adjusted based on the monitored performance of the valve. For example, should a valve exhibit sluggishness in transition between positions or states, the controller can transmit command signals to the valve that compensate for the sluggishness of the valve which extends the operational use of the downhole tool. Thus, the valve engagement time, disengagement time or both can be dynamically adjusted essentially in real time based on actual downhole information as opposed to assumptions about downhole conditions.

In one or more embodiments, a flow through actuation path used by the valve to actuate the movement of the extendable members or pads may become obstructed either partially or fully. As discussed above, by monitoring the performance of the valve, for example, using one or more sensors (such as a pressure sensor, a movement sensor that senses movement of the extendable pad or one or more coupled components, or both), a determination may be made that the valve has not experienced any failure or the valve is not hindering any operation but rather a blockage is interfering with the performance of the pad extension.

In one or more aspects of the present disclosure, a well site operation may utilize an information handling system to control one or more operations including, but not limited to, a motor or powertrain, a downstream pressurized fluid system, or both. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Turning now to the figures, FIG. 1 depicts a schematic view of a drilling operation utilizing a directional drilling system 100, according to one or more aspects of the present invention. The system of the present disclosure will be specifically described below such that the system is used to direct a drill bit in drilling a wellbore, such as an offshore or subsea well or an on shore or land well. Further, it will be understood that the present disclosure is not limited to only drilling a hydrocarbon, such as natural gas or oil, well. The present disclosure also encompasses wellbores in general, for example, for water. Further, the present disclosure may be used for the exploration and formation of geothermal wellbores intended to provide a source of heat energy instead of hydrocarbons.

Accordingly, FIG. 1 depicts a tool string 126 disposed in a directional borehole or well bore 116. The tool string 126 including a rotary steerable tool 128 in accordance with various embodiments. The rotary steerable tool 128, for example, for a RSS, provides full three-dimensional (3D) directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. In one or more embodiments, a topdrive is used to rotate the drill string 108 in place of the kelly 110 and the rotary table 112. A drill bit 114 is positioned at or coupled to the downhole end of the tool string 126, and, in one or more embodiments, may be driven by a downhole motor 129 positioned on the tool string 126, by rotation of the entire drill string 108 from the surface or both. As the drill bit 114 rotates, the drill bit 114 creates the borehole 116 that passes through various formations 118. A pump 120 circulates fluid through a feed pipe 122, for example, drilling fluid, and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116. The drilling fluid may also drive the downhole motor 129.

The tool string 126 may include one or more logging while drilling (LWD) or measurement-while-drilling (MWD) tools 132 that collect measurements relating to various borehole and formation properties as well as the position of the drill bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring fluid pressure, temperature sensors for measuring borehole temperature, or any other downhole tool or combination thereof.

The tool string 126 may also include a telemetry module 134. The telemetry module 134 receives data provided by the various sensors of the tool string 126 (for example, sensors of the LWD/MWD tool 132), and transmits the data to a surface control unit 138. Data may also be provided by the surface control unit 138, received by the telemetry module 134, and transmitted to the tools (for example, LWD/MWD tool 132, rotary steering tool 128, or any other tool) of the tool string 126. In one or more embodiments, mud pulse telemetry, wired drill pipe, acoustic telemetry, or other telemetry technologies known in the art may be used to provide communication between the surface control unit 138 and the telemetry module 134. In one or more embodiments, the surface control unit 138 may communicate directly with the LWD/MWD tool 132, the rotary steering tool 128 or both. The surface control unit 138 may be an information handling system, for example, an information handling system 700 of FIG. 7, stationed at the well site, a portable electronic device, a remote computer, or distributed between multiple locations and devices. The surface control unit 138 may also be a control unit that controls functions of equipment of the tool string 126.

The rotary steerable tool 128 is configured to change the direction of the tool string 126, the drill bit 114 or both, such as based on information indicative of tool 128 orientation and a desired drilling direction and operation of an extendable member assembly 130. In one or more embodiments, extendable member assembly 130 comprises an extendable member and an extendable member diagnostic assembly, for example, extendable member 202 and extendable member diagnostic assembly 250 of FIG. 2. In one or more embodiments, the rotary steerable tool 128 is coupled to the drill bit 114 and drives rotation of the drill bit 114. In one or more embodiments, the rotary steerable tool 128 rotates in tandem with the drill bit 114. In one or more embodiments, the rotary steerable tool 128 is a point-the-bit system or a push-the-bit system.

Figure 2A:
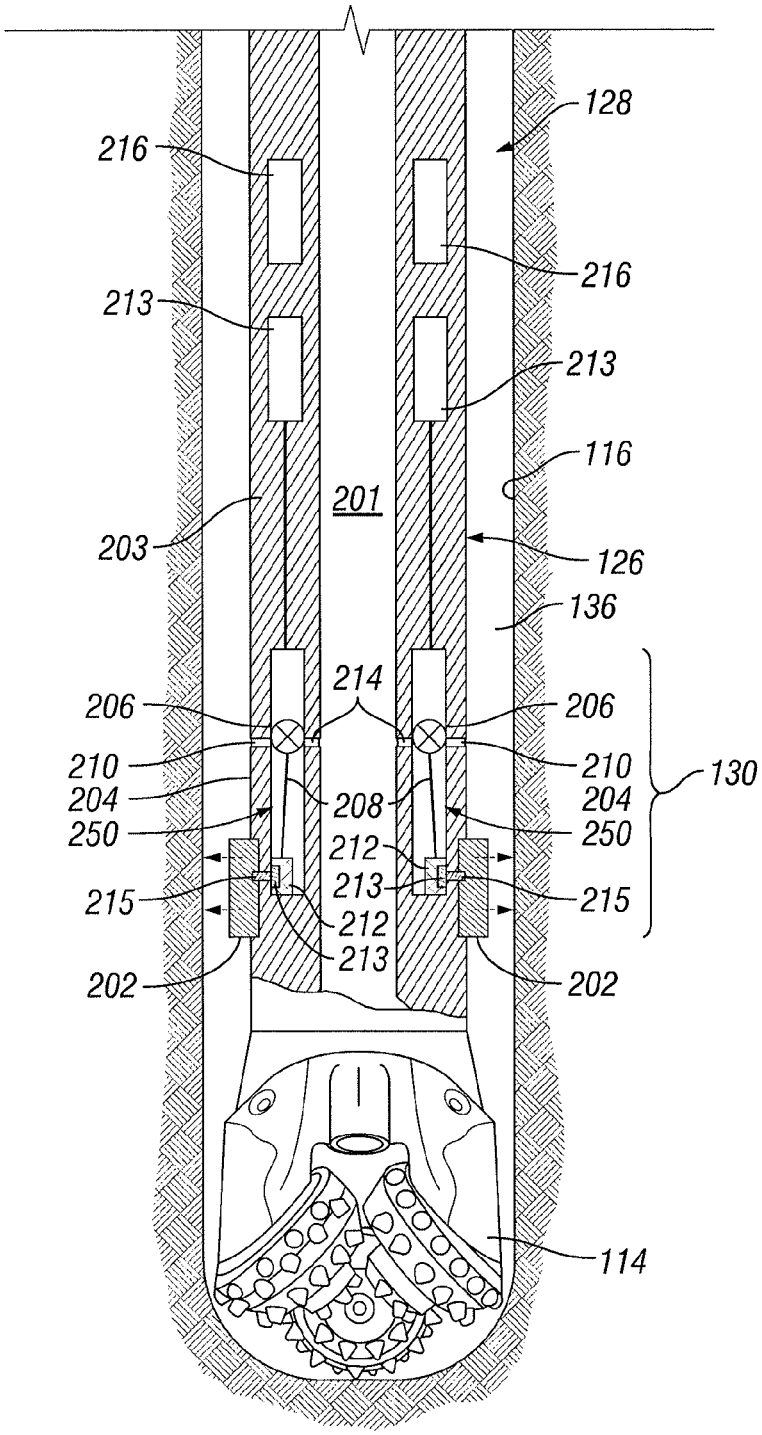
FIG. 2A depicts a cross-sectional schematic view of a rotary steerable system with an extendable member diagnostic assembly, according to one or more aspects of the present disclosure.

FIG. 2A depicts a cross-sectional schematic view of the rotary steerable tool 128 in the borehole 116, according to one or more aspects of the present invention. In one or more embodiments, the rotary steerable tool 128 includes a tool body 203 and a flowbore 201 through which fluid such as fluid 240 of FIG. 2D flows, for example, drilling fluid, gas (for example, nitrogen entrained in fluid or two phase fluid), mud, cutting fluid, water, slurry or any other type of fluid. The rotary steerable tool 128 further comprises an extendable member assembly 130 located, disposed or positioned at or near the outer surface 204 of the rotary steerable tool 128. Extendable member assembly 130 comprises one or more extendable members 202 and diagnostic assembly 250. In one or more embodiments, one or more diagnostic assemblies 250 couple to the one or more extendable member assemblies 130. For example, in one or more embodiments, a single diagnostic assembly 250 may couple to a plurality of extendable member assemblies 130. The diagnostic assembly 250 monitors, for example, degradation of performance of one or more valves 206. In one or more embodiments, the one or more extendable members 202 comprise one or more extendable pads (not shown).

The one or more extendable members 202 are configured to extend outwardly from the rotary steerable tool 128 upon actuation to push against a desired or predetermined arc length segment of the wall of the borehole 116 while the rotary steerable tool 128 rotates with the drill bit 114 by the urging of the rotary drive. This pushing by the extendable member 202 against the wall of the borehole 116 exerts a force on the drill bit 114 on the opposite side of the borehole 116, pushing the drill bit 114 to drill towards a desired or predetermined direction. Thus, the extendable members 202 are actuated into the extended position only when the extendable members 202 are in a certain rotational position and over a certain arc length interval of the rotation. In one or more embodiments, for a push-the-bit system, the resultant force of all the actuated extendable members 202 applied on the wall of the borehole 116 should be in the opposite direction as the desired driving direction of the drill bit 114. In one or more embodiments, for a point-the-bit system, a fulcrum stabilizer may be positioned between the rotary steerable tool 128 and the drill bit 114. In the case of the point-the-bit system, the resultant force of all the actuated extendable members 202 applied on the wall of the borehole 116 should be in the opposite direction as the desired driving direction of the drill bit 114. As the extendable members 202 are only put into the extended position when in the appropriate position during rotation of the rotary steerable tool 128, the extendable members 202 are pulled back to the rotary steerable tool 128 once the extendable members 202 are no longer in the appropriate position. The extendable members 202 may each be controlled independently or in groups. In one or more embodiments, hydraulic pressure is directed to the desired extendable member 202 or an associated piston chamber 212 to actuate the extension of the extendable member 202. Piston chamber 212 comprises piston 213 and piston 213 is coupled to a piston rod 215 that is coupled to extendable member 202. The present disclosure contemplates that any type of actuation may be utilized including, but not limited to, pneumatic, hydraulic, mechanical, electrical actuation or any combination thereof. For example, with respect to hydraulic actuation, a fluid 240 may serve as power delivery fluid or an isolated system having a separate hydraulic fluid may sever as the power delivery medium either of which drives the one or more extendable members 202 to exert a force against the borehole 116. In one or more embodiments, the hydraulic fluid may comprise a mineral oil or any other suitable fluid which is generally free of particles when compared with the drilling fluid. Closed systems use a different fluid than the fluid 240 and do not interact with the fluid 240. That is, a closed system remains isolated from the fluid 240, for example, a drilling fluid, using seals or other isolation mechanisms. For example, a closed system or isolated system generally extracts power from the flow of the fluid 240 through the borehole 116 such as by a hydraulic pump driven by a turbine that is driven by fluid 240.

As an example of hydraulic actuation, in one or more embodiments, extension of the extendable members 202 is enabled by generating a pressure differential between the flowbore 201 of the tool string 126 and the annulus 136 surrounding the tool string 126 and inside the borehole 116. In one or more embodiments, the extendable members 202, or intermediate actuation devices such as piston chambers 212 or pistons 213, are each coupled to the flowbore 201 via a supply path 214 and actuation path 208 formed in the tool body 203. The actuation path 208 is also coupled to a bleed path 210 formed in the tool body 203 which hydraulically couples to the annulus 136. The supply path 214 is coupled to the actuation path 208 via a valve 206. In one or more embodiments, valve 206 may comprise a solenoid valve, any electrically actuated valve, or any other suitable valve.

Figure 2B:
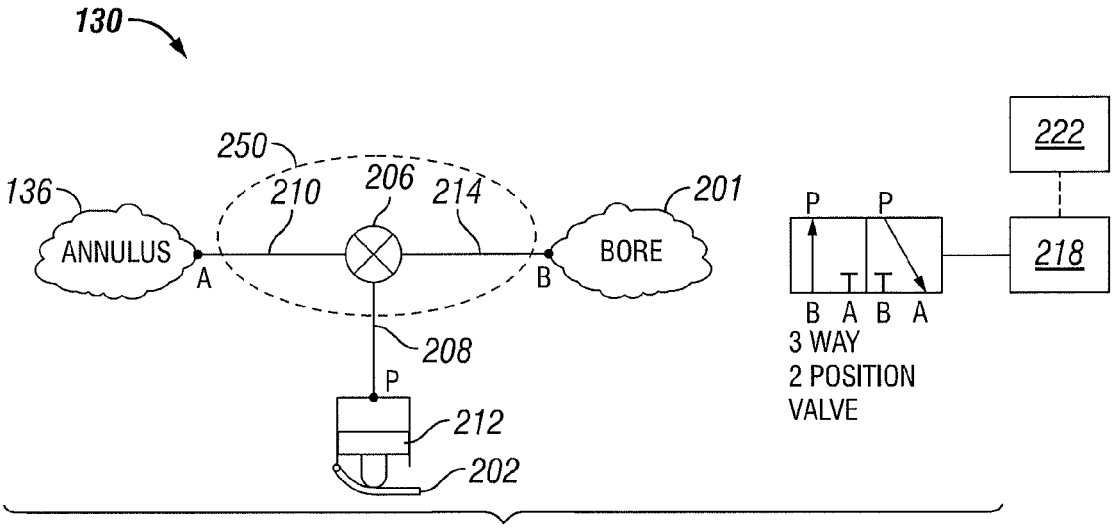
FIG. 2B depicts an example hydraulic configuration of the rotary steerable system with an extendable member diagnostic assembly, according to one or more aspects of the present disclosure.
Figure 2C:
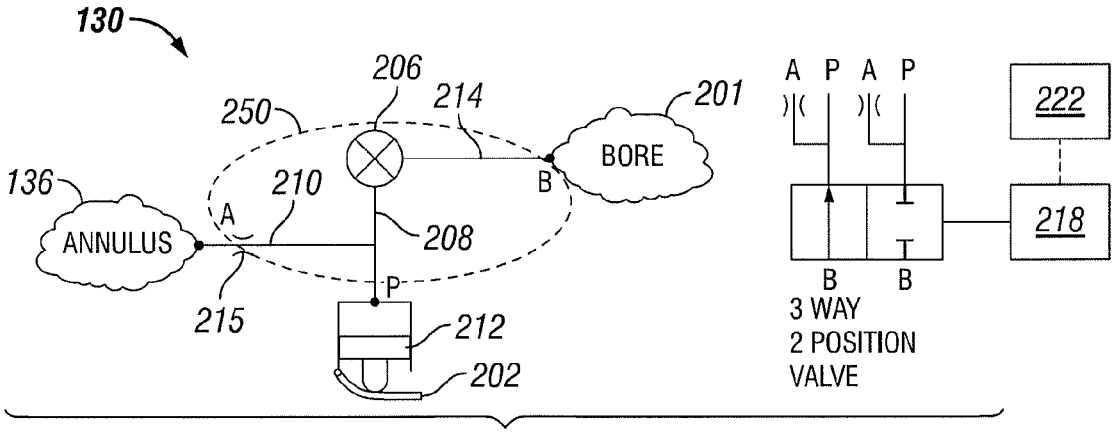
FIG. 2C depicts an example hydraulic configuration of the rotary steerable system with an extendable member diagnostic assembly, according to one or more aspects of the present disclosure.

The valve 206 can be controlled to hydraulically couple and decouple the actuation path 208 from the supply path 214. In one or more embodiments, the extendable members 202 may be selectively extended by selective actuation of valve 206. For example, an operator of the rotary steerable tool 128 may selectively adjust valve 206 using an interface of the surface control unit 138 that causes a command to be sent to selectively adjust the actuation characteristics of at least one of the valves 206. Valve and flow path configurations include but are not limited to the following configurations as depicted in FIG. 2B and FIG. 2C. As depicted in FIG. 2B which illustrates an example hydraulic configuration of the rotary steerable system, when the valve 206 is actuated by actuator 218 based, at least in part, on a control signal from the controller 222, the actuation path 208 and the supply path 214 are coupled to the flowbore 201. Due to the pumping of fluid into the flowbore 201 and the pressure drop at the bit, the flowbore 201 is at a high pressure relative to the annulus 136. As a result, fluid flows into the actuation path 208 from the flowbore 201. The increase in pressure in the actuation path 208 actuates extension of the piston 213, piston rod 215 and extendable member 202. When the valve 206 is in the open position or state, the actuation path 208 is closed to the bleed path 210 and thus full differential pressure, between the flowbore 201 and annulus 136, is applied to the piston 213. During deactivation of the valve 206 or when the valve 206 is in the closed state, the activation path 208 is open to the bleed path 210 and piston 213 is allowed to push the fluid to the annulus 136 via the bleed path 210.

As depicted in FIG. 2C, when the valve 206 is actuated, the actuation path 208, supply path 214, and bleed path 210 are coupled to the flowbore 201 and to each other. Due to the pumping of fluid into the flowbore 201 and the pressure drop at the bit, the flowbore 201 is at a high pressure relative to the annulus 136. As a result, fluid flows into the actuation path 208 and bleed path 210 from the flowbore 201. The increase in pressure in the actuation path 208 actuates extension of the piston 213, the piston rod 215 and extendable member 202. It should be noted that some volume of fluid is flowing to the annulus via the bleed path 210, and that sufficient restriction 215 is necessary to maintain sufficient pressure differential between the flowbore 201 and annulus 136 in order to extend the piston 213, the piston rod 215 and extendable member 202. During deactivation of the valve 206 by actuator 218 based, at least in part, on a control signal from the controller 222, the activation path 208 is open to the bleed path 210 and piston 213 is allowed to push the fluid to the annulus 136 via the bleed path 210. In one or more embodiments, the piston 213 is coupled to the actuation path 208 and the increase in pressure actuates the piston 213. The piston 213 may cause a piston rod 215 to extend outward upon actuation and push the extendable member 202 outward. In one or more embodiments, the extendable member 202 is absent and the piston 213 with piston rod 215 pushes against the borehole 116.

Each extendable member 202 can be opened independently through actuation of the respective valve 206. Any subset or all of the extendable members 202 can be opened at the same time. In one or more embodiments, the amount of force by which piston 213, piston rod 215 or extendable member 202 pushes against the borehole 116 or the amount of extension may be controlled by controlling the flow of fluid into the actuation path 208, which can be controlled via the valve 206 or various other valves or orifices placed along the actuations path 208 or the bleed path 210. This helps enable control over the degree of direction change of the drill bit 114. The rotary steerable tool 128 may comprise one or more sensors 216 for making any measurement including measurement while drilling data, logging while drilling data, formation evaluation data, temperature, pressure, velocity, speed, any other downhole data or any combination thereof.

Figure 2D:
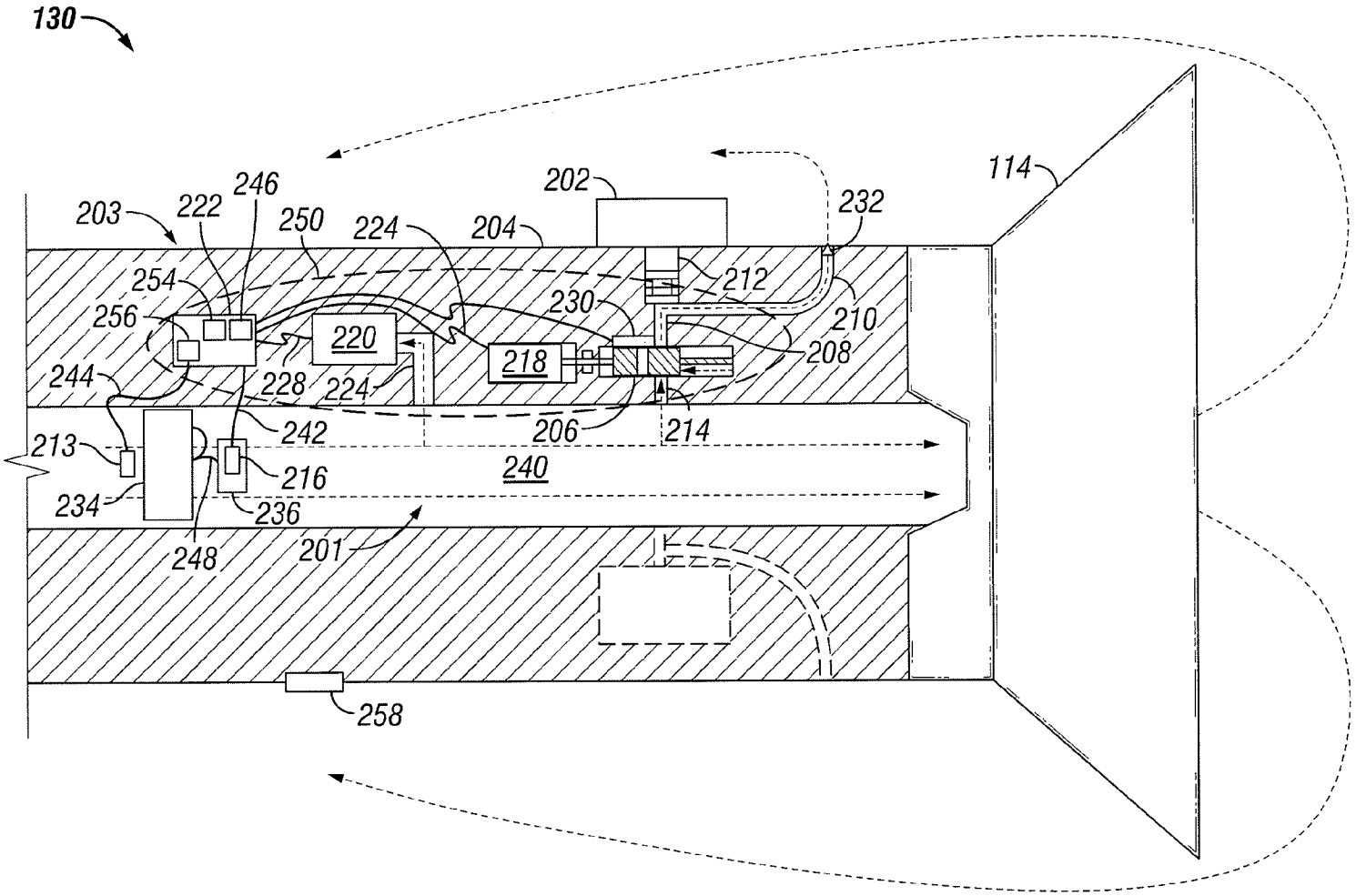
FIG. 2D depicts an extendable member assembly with an extendable member diagnostic assembly for a rotary steerable system, according to one or more aspects of the present disclosure.

FIG. 2D depicts an extendable member assembly 130 with an extendable member diagnostic assembly 250 for a rotary steerable system, according to one or more aspects of the present disclosure. An extendable member assembly 130 may comprise one or more extendable members 202 and an extendable member diagnostic assembly 250. One or more extendable members 202 are disposed or positioned circumferentially, linearly or both on or about the tool body 203. An extendable member 202 is coupled to a piston 213, for example, via piston rod 215. Piston 213 is disposed within a piston chamber 212. Piston chamber 212 or piston 213 is coupled mechanically, electrically, fluidically or any combination thereof to an extendable member diagnostic assembly 250.

Extendable member diagnostic assembly 250 comprises an actuator 218, a sensor 230, a valve 206, one or more flow paths 208, 210 and 214, a controller 222 and a pressure sensor 220. Valve 206 is coupled mechanically, electrically, fluidically or any combination thereof to piston chamber 212 and actuator 218. While actuator 218 is discussed herein, the present disclosure contemplates use of any actuator including, but not limited to a hydraulic actuator, a pneumatic actuator, an electric actuator, a mechanical actuator or any combination thereof. For example, in one or more embodiments, the actuator 218 may comprise a solenoid, a piezoelectric actuator or any other actuator or combination thereof. Any one or more of sensor 230, actuator 218 and pressure sensor 220 are communicatively coupled (such as directly or indirectly, wired or wireless) to a controller 222 via one or more pathways 226, 224 and 228, respectively.

The pressure sensor 220, for example, a pressure transducer, receives a fluid 240, for example, a drilling fluid, via a flow path 224 and measures the pressure in the flowbore 201. The pressure sensor 220 communicates one or more measurements to the controller 220 via the pathway 228. In one or more embodiments, the controller 222 comprises an information handling system, for example, information handling system 700 of FIG. 7.

Figure 2E:
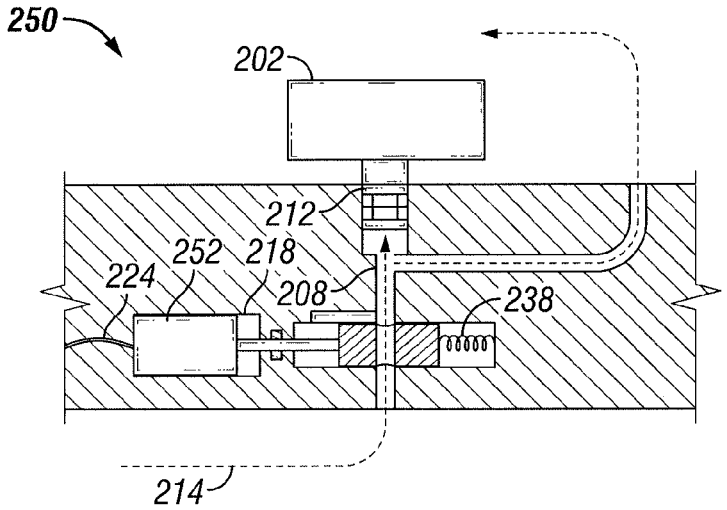
FIG. 2E depicts a partial view of an extendable member diagnostic assembly for a rotary steerable system, according to one or more aspects of the present disclosure.

In one or more embodiments, the extendable members 202 provide steering for a RSS, for example, rotary steerable tool 128 of FIG. 1. The actuator 218 transitions between positions or states (for example, any one or more locations or positioning at or between an open position or state and a closed position or state) to actuate valve 206 to direct or control flow of fluid 240 from the flowbore 201 to the extendable members 202. The pressure sensor 220 measures fluid pressure associated with fluid 240 in the flowbore 201. Sensor 230 monitors a response characteristic, position, state or status of the valve 206. Sensor 230 may be positioned or disposed at or about the valve 206, between the actuator 218 and the valve 206 or any other suitable location. In one or more embodiments, sensor 230 detects a response characteristic indicative of activation or deactivation of the actuator 218. Data, for example, one or more measurements, from the sensor 230 associated with the position, state or status of the valve 206 is communicated to the controller 222 via the pathway 226. For example, the position, state or status of the valve 206 may be indicative of a state of the valve 206 where a state of the valve may include, but is not limited to, an open position or state, a closed position or state, or any position in between. The controller 222 communicates with the actuator 218 via pathway 224 to selectively actuate the actuator 218 to transition valve 206 to an open position or state. For example, as illustrated in FIG. 2E, the controller 222 may transmit or communicate a control signal via pathway 224 to cause a transition of the actuator 218, for example, to cause a current to be applied to one or more coils 252 of the actuator 218 which causes the valve 206 to transition to an open position or state and to compress or deform one or more springs 238. When the valve 206 is in the open position or state, fluid 240 flows through supply path 214 through the valve 206 to piston chamber 212 (and piston 213 and piston rod 215) to actuate or extend extendable member 202. When extendable member 202 is extended, extendable member 202 may contact a wall of the borehole 116 to steer the drill bit 114 in the desired or predetermined direction.

Figure 2F:
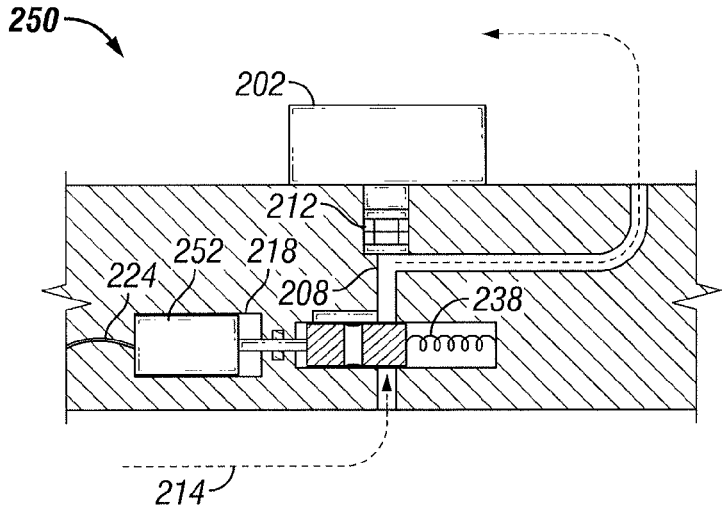
FIG. 2F depicts a partial view of an extendable member diagnostic assembly for a rotary steerable system, according to one or more aspects of the present disclosure.

In one or more embodiments, controller 222 may transmit or communicate a control signal via pathway 224 to actuator 218, for example as illustrated in FIG. 2F, to cause a reverse current to be applied to one or more coils 252 of the actuator 218. The reverse current causes the actuator 218 to change states or to retract which allows the spring 238 to expand to force or actuate the valve 206 to the closed position or state. When valve 206 is in the closed position or state, fluid 240 is not permitted to flow through the valve 206 via supply path 214.

In one or more embodiments, a flow meter or sensor 216 may be disposed or positioned in an electronics module 236. Flow meter or sensor 216 detects or measures the flow rate of fluid 240 through the flowbore 201. Electronics module 236 may be disposed in the flowbore 201 and communicatively coupled via pathway 248 to a turbine 234 disposed or positioned in the flowbore 201, communicatively coupled to controller 222 or both. A geolocation device 213 may be disposed or position in the flowbore 201 to sense positioning of the rotary steerable tool 128 as discussed in more detail with respect to FIG. 6. The controller 222 may receive one or more measurements from flow meter or sensor 216 via pathway 242 and geolocation device 213 via pathway 244. Controller 222 may comprise a sensor 246, a temperature sensor 254, an orientation sensor 256, or any other sensor or combination thereof. The sensor 246 may comprise a voltage sensor, a current sensor or both. In one or more embodiments, sensor 246, temperature sensor 254, orientation sensor 256 or any combination thereof may be positioned or disposed outside of the controller 222 and communicatively coupled to the controller 222. The voltage or current sensor 246 detects the voltage, current, power or any combination thereof required to actuate the actuator 218. A rotational sensor 258 that measures rotations per minute (RPM) of the rotary steerable tool 128 may be disposed or positioned on or about the tool body 203. In one or more embodiments, any one or more of the voltage or current sensor 246, temperature sensor 254, orientation sensor 256 and rotational sensor 258 may be disposed or positioned within the controller 222 or at or about any other position or location of the rotary steerable tool 128.

Flow characteristics of fluid, such as fluid 240, through the rotary steerable tool 128 and the borehole 116 play an important role in controlling overall system performance of the rotary steerable tool 128. The operating pressure of the rotary steerable tool 128 is determined by a pressure drop across the drill bit 114 and, by extension, the flow of fluid 240 through the drill bit 114. If the flow of fluid 240 through the drill bit 114 is reduced, the pressure drop is reduced. When a valve 206 is opened, pressure across the drill bit 114 drops, as part of the flow of the fluid 240 is directed to bypass through the valve 206. When valve 206 is closed, pressure across the drill bit 114 rises. Pressure sensor 220 measures internal borehole pressure. One or more sensors 230 monitor a position or status of the solenoid actuated valve 206, an extension or retraction of the actuator 218 or both. The controller 222 utilizes information or data received from the pressure sensor 220, the sensor 230, any other sensor or device to diagnose and compensate for variation and degradation in performance of the actuator 218, the valve 206, the extendable member 202, the piston chamber 212, piston 213, piston rod 215 or any combination thereof.

Figure 3A:
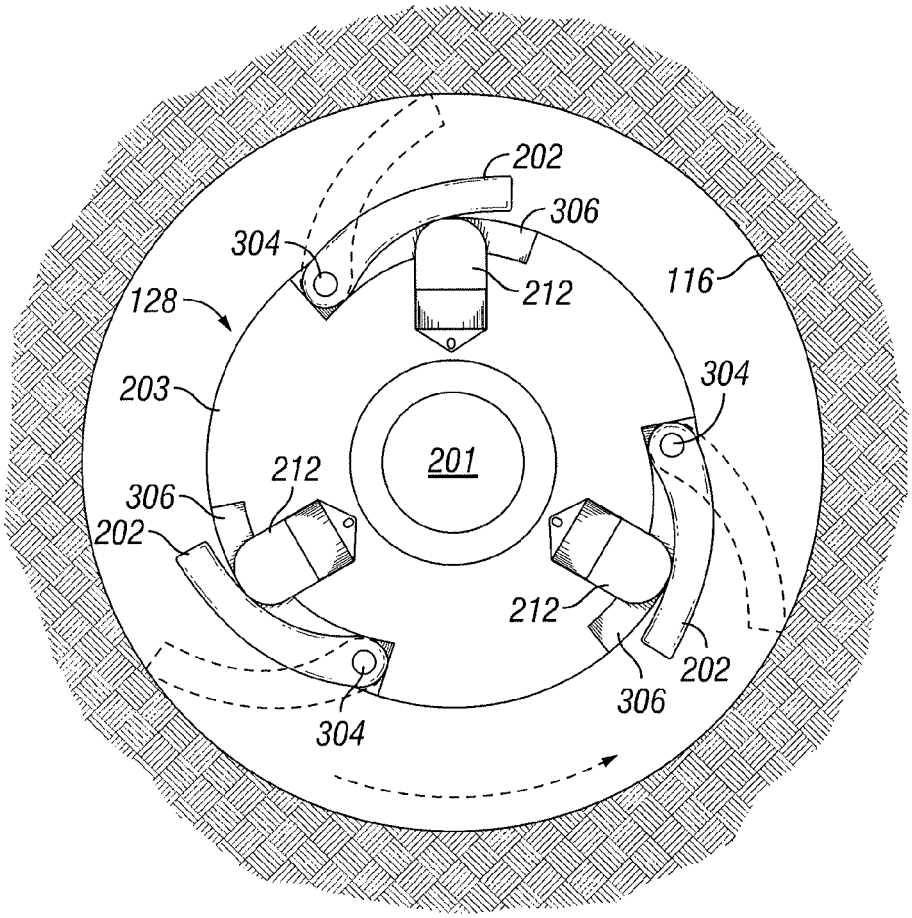
FIG. 3A depicts a radial cross-sectional schematic view of the rotary steerable system with an extendable member assembly, according to one or more aspects of the present disclosure.

FIG. 3A depicts a radial cross-sectional schematic view of the rotary steerable tool 128, with an extendable member assembly 130 that comprises the extendable members 202 where control of extendable members 202 is based, at least in part, on an extendable member diagnostics assembly 250 according to one or more aspects of the present disclosure. As shown, the extendable members 202 are close to or in contact with the tool body 203 in a closed position or state and configured to extend outward into an open or actuated position. In the illustrated example, the extendable members 202 are coupled to the tool body 203 and pivot between the closed and open positions or states via hinges 304 when actuated as discussed with respect to FIGS. 2E and 2F. As mentioned above, the extendable members 202 can be pushed outward and into the open position or state by the piston rods 215 associated with pistons 213. In one or more embodiments, the tool body 203 includes recesses 306 which house the extendable members 202 when in the closed position or state, thereby allowing the extendable members 202 to be flush with the tool body 203.

In one or more embodiments, the rotary steerable tool 128 includes three extendable members 202 spaced 120 degrees apart around the circumference of the tool 128. In one or more embodiments, any number of extendable members 202 may be spaced at any location or position about the circumference of the tool 128. In one or more embodiments, the rotary steerable tool 128 comprises a single extendable member 202. The extendable member 202 and piston 213 illustrate one configuration of an extendable mechanism for a RSS, for example, rotary steerable tool 128, designed to push against the wall of the borehole 116 to urge or direct the drill bit 114 in a direction. The rotary steerable tool 128 may include various other types of extendable members or mechanisms, including, but not limited to, pistons configured to push against the borehole 116 directly or extendable members 202 configured to be acted on by fluid direction without an intermediate piston.

The extendable members 202, or alternative extendable members or a mechanism, may also include a retraction mechanism that actuates or transitions the extendable members 202 back into the closed position or state, such as when the extendable members 202 are out of the appropriate position. For example, the extendable members 202 may include a spring that pulls the extendable members 202 back into the closed position or state. In one or more embodiments, the extendable members 202 may be configured to fall back into the closed position or state when pressure applied by the fluid 240 at the extendable members 202 drops below a threshold. Retraction of the extendable members 202 reduces wear on the extendable members 202 and pistons 213 and piston rods 215. In one or more embodiments, the extendable members 202 are coupled to the piston 213 (directly or indirectly, for example, via piston rod 215) and thus travel with the piston 213. In one or more embodiments, the extendable members 202 may also function as centralizers, in which all the extendable members 202 remain in the extended position, keeping the rotary steerable tool 128 centralized in the borehole 116. In such embodiments, the retraction mechanism can be disabled or not included.

Figure 3B:
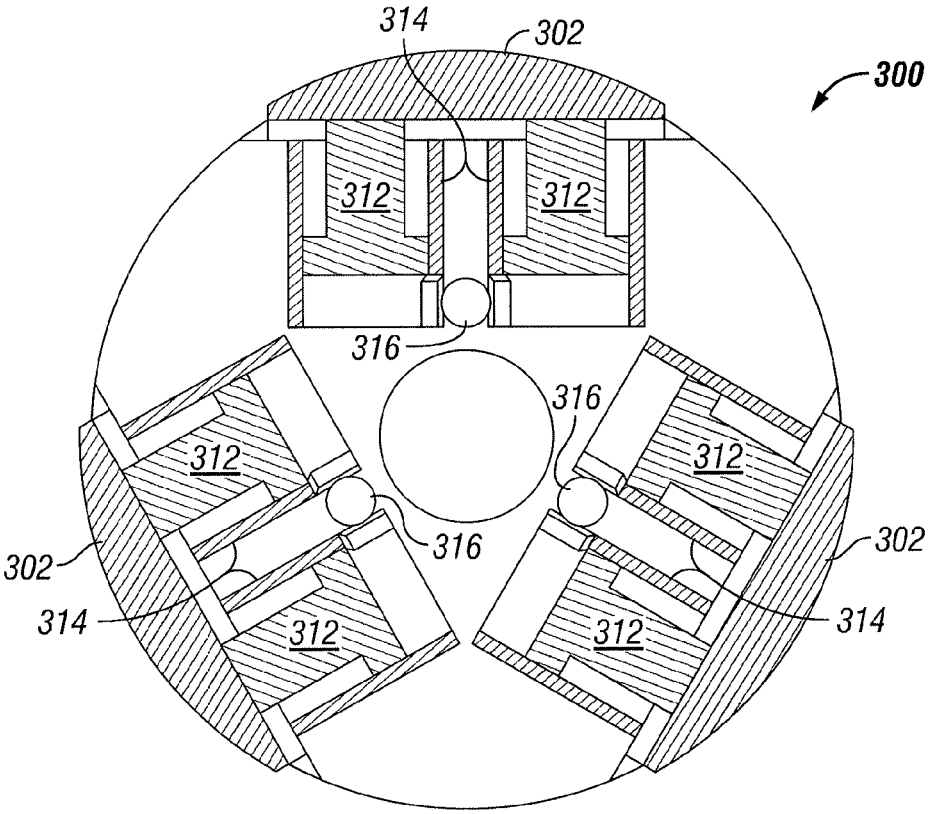
FIG. 3B depicts a radial cross-sectional schematic view of an example embodiment of the rotary steerable system with an extendable member assembly, according to one or more aspects of the present disclosure.

FIG. 3B depicts a radial cross-sectional schematic view of an example rotary steerable tool 300, with an extendable member assembly, according to one or more aspects of the present disclosure. Rotary steerable tool 300 comprises a plurality of extendable members 302 located around the rotary steerable tool 300 and a plurality of pistons 312 configured to push the extendable members 302 outwardly or towards the borehole 116. In one or more embodiments, and as illustrated, each extendable member 302 is pushed by two pistons 312. The pistons 312 may also be coupled to the respective extendable members 302. Each piston 312 is coupled to a hydraulic line 316 which provides a source of hydraulic pressure. Additionally, in some embodiments, each piston 312 includes a wear sleeve 314 for protecting the parts from wear caused by movement of the piston 312.

Figure 4A:
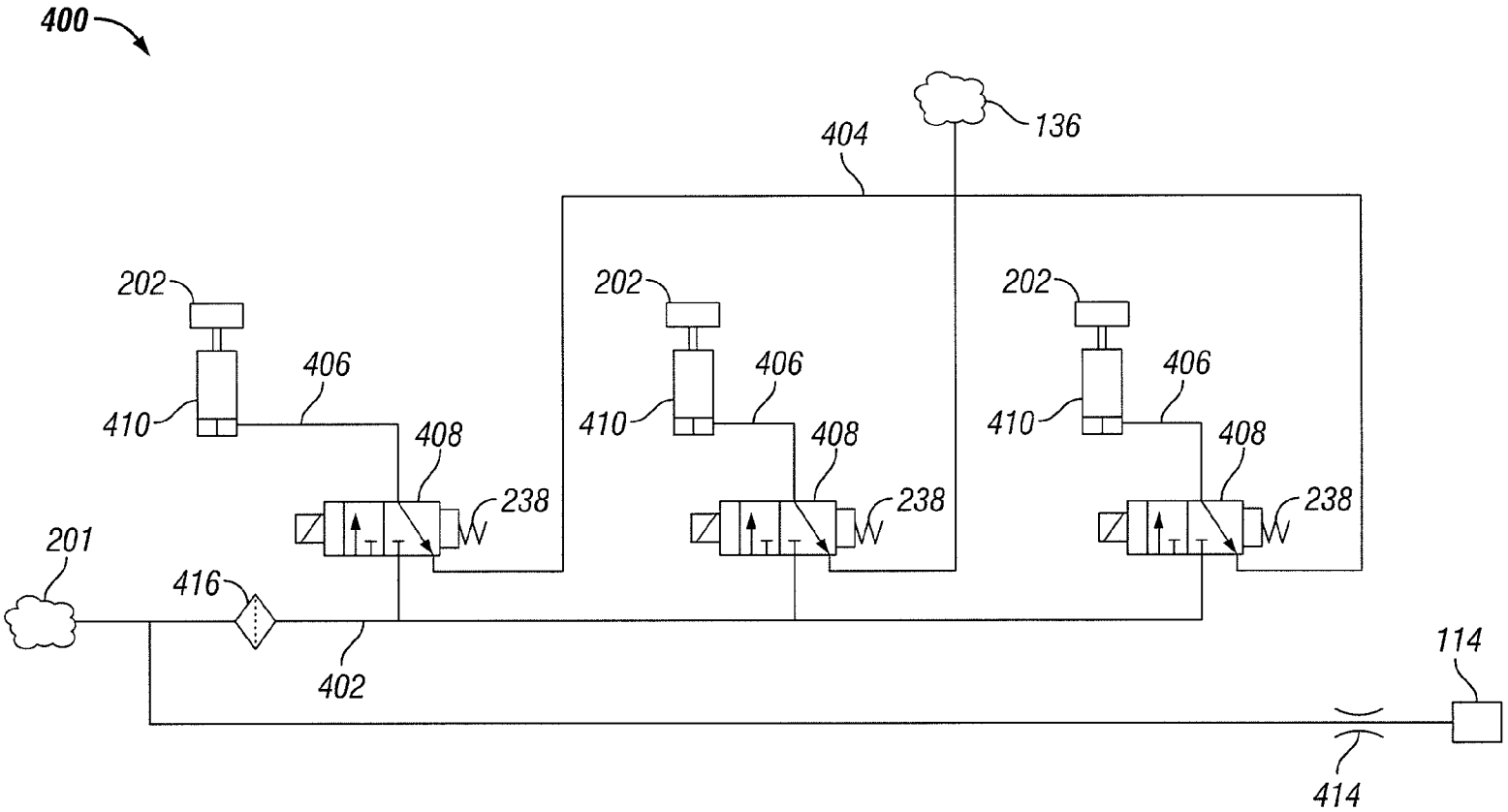
FIG. 4A depicts an example hydraulic circuit of a rotary steerable tool, according to one or more aspects of the present disclosure.

FIG. 4A depicts a hydraulic circuit 400 of the rotary steerable tool 128 using hydraulic actuation to actuate or move the extendable members 202 of an extendable member assembly 130, in accordance with one or more aspects of the present disclosure. A plurality of 3 way-2 position valves utilize differential mud pressure between the flowbore 201 and annulus 136. The hydraulic circuit 400 utilizes a pressure differential between the fluid 240 pumped into the rotary steerable tool 128 and the annulus 136 around the rotary steerable tool 128. The hydraulic circuit 400 includes a high pressure line 402, which represents the inside of the tool, for example, rotary steerable tool 128, into which fluid 240 is pumped, and a low pressure line 404, which represents the annulus 136. The high pressure line 402 is coupled to the flowbore 201, which provides flow restriction and the resulting differential pressure. Additionally, a flow restrictor 414 may be added to increase pressure differential in the case that the drill bit 114, alone, does not provide a sufficient pressure differential. In one or more embodiments, a flow restrictor 414 may be disposed between the drill bit 114 and the flowbore 201. As illustrated in FIG. 4A the flow restrictor 414 may couple to flowbore 201 and drill bit 114. In one or more embodiments, a filter 416 may couple to the flowbore 201 and the high pressure line 402 to remove large particulates from the fluid flowing through the flowbore 201 to prevent clogging or jamming of one or more pistons 410, electrically actuated valves 408 and any flow path to the annulus 136. In one or more embodiments, a filter 416 is not utilized such that flowbore 201 couples to the high pressure line 402 without first being coupled to the filter 416. The high pressure line 402 is also coupled to one or more electrically actuated valves 408. Each electrically actuated valve 408 is coupled to a hydraulic piston line 406, and the low pressure line 404. Generally, each hydraulic piston line 406 is associated with a piston 410 and an extendable member 202 on the rotary steerable tool 128. For example, for each hydraulic piston line 406 a corresponding piston 410, extendable member 202 or both is utilized. The electrically actuated valves 408 separate the high pressure line 402 from the hydraulic piston lines 406, thereby separating the high pressure line 402 from the pistons 410. The electrically actuated valves 408 also separate the hydraulic extendable member lines 406 from the low pressure line 404, thereby separating the pistons 410 from the low pressure line 404.

The electrically actuated valves 408 can be individually controlled to couple or decouple the high pressure line 402 and each of the hydraulic extendable member lines 406. In one or more embodiments, when an electrically actuated valve 408 is actuated, the high pressure line is in fluid communication with the respective hydraulic piston line 406 and the respective piston 410. The pressure differential between the low pressure line 404 and the high pressure line 402 pushes fluid 240 through the respective hydraulic piston line 406, thereby actuating the piston 410. Actuation of the piston 410 causes extendable member 202 or another protrusion to extend outwardly from the rotary steerable tool 128, applying a force on the wellbore, for example, borehole 116, thereby changing the drilling direction. When an electrically actuated valve 408 is deactivated, the respective piston 410 is isolated from the high pressure line 402, and the piston 410 is in fluid communication with the low pressure line 404, allowing the piston 410 to retract and drain fluid 240 through the low pressure line 404 to the annulus 136. In one or more embodiments, fluid 240 is a drilling fluid.

Figure 4B:
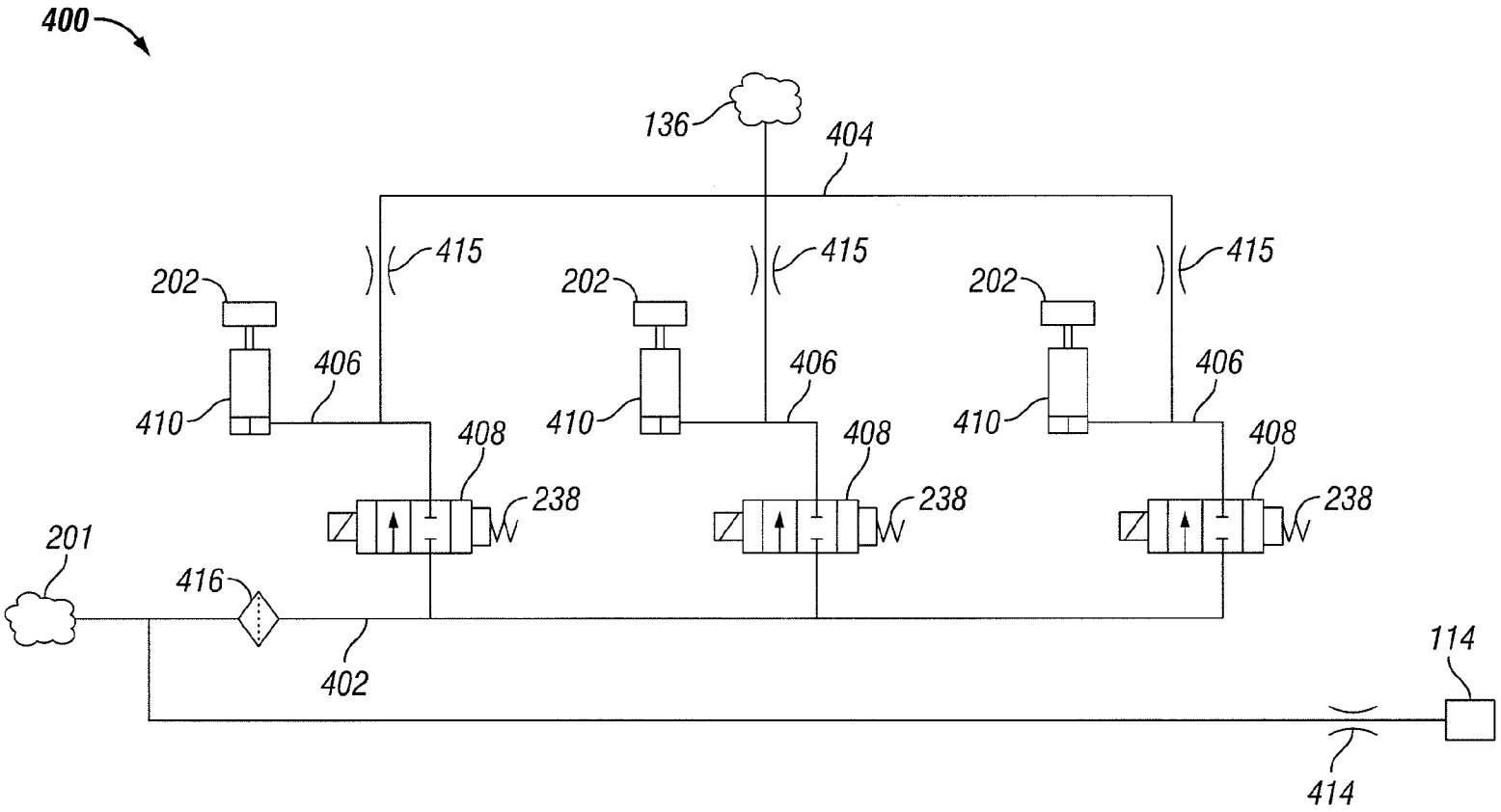
FIG. 4B depicts an example hydraulic circuit of the rotary steerable tool, according to one or more aspects of the present disclosure.

FIG. 4B depicts a hydraulic circuit 400 of the rotary steerable tool 128 using hydraulic actuation to move the extendable members 202 of an extendable member assembly 130, in accordance with one or more embodiments. FIG. 4B illustrates a plurality of 2 way-2 position valves that utilize differential mud pressure between the flowbore 201 and annulus 136. The hydraulic circuit 400 utilizes a pressure differential between the fluid 240 pumped into the rotary steerable tool 128 and the annulus 136 around the rotary steerable tool 128. The hydraulic circuit 400 includes a high pressure line 402, which represents the inside of the rotary steerable tool 128 into which fluid 240 is pumped, for example, by pump 120, and a low pressure line 404, which represents the annulus 136. The high pressure line 402 is coupled to the flowbore 201, which provides flow restriction and the resulting differential pressure. Additionally, if necessary, a flow restrictor 414 can be added to increase pressure differential in the case where the drill bit 114, alone, does not provide a sufficient pressure differential. In one or more embodiments, a flow restrictor 414 may be disposed between the drill bit 114 and the flowbore 201. As illustrated in FIG. 4A the flow restrictor 414 may couple to flowbore 201 and drill bit 114. In one or more embodiments, a filter 416 may couple to the flowbore 201 and the high pressure line 402 to remove large particulates from the fluid flowing through the flowbore 201 to prevent clogging or jamming of one or more pistons 410, electrically actuated valves 408 and any flow path to the annulus 136. In one or more embodiments, a filter 416 is not utilized such that flowbore 201 couples to the high pressure line 402 without first being coupled to the filter 416.

The high pressure line 402 is also coupled to one or more electrically actuated valves 408. Each electrically actuated valve 408 is also coupled to a hydraulic piston line 406 and a low pressure line 404. Generally, each hydraulic piston line 406 is associated with a piston 410, an extendable member 202 or both on the rotary steerable tool 128. For example, for each hydraulic piston line 406 a corresponding piston 410, extendable member 202 or both is utilized. The electrically actuated valves 408 separate the high pressure line 402 from the hydraulic extendable member lines 406, thereby separating the high pressure line 402 from the pistons 410 and the low pressure line 404. The electrically actuated valves 408 can be individually controlled to couple or decouple the high pressure line 402 and each of the hydraulic piston lines 406. In one or more embodiments, when an electrically actuated valve 408 is actuated, the high pressure line is in fluid communication with the respective hydraulic piston line 406, its respective piston 410, and the low pressure line 404. The pressure differential between the low pressure line 404 and the high pressure line 402 pushes fluid 240 through the respective hydraulic piston line 406, thereby actuating the piston 410.

Actuation of the piston 410 causes extendable member extension or another protrusion to extend outwardly from the rotary steerable tool 128, applying a force on the borehole 116, thereby changing the drilling direction. It should be noted that some volume of fluid 240 is flowing to the annulus 136 via the low pressure line 404 and that sufficient restriction 415 is necessary to maintain sufficient pressure differential, between the flowbore 201 and annulus 136 in order to extend the piston 410 and extendable member 202. When an electrically actuated valve 408 is deactivated, the respective piston 410 is isolated from the high pressure line 402, and the piston 410 is in fluid communication with the low pressure line 404, allowing the piston 410 to retract and drain fluid 240 through the low pressure line 404 to the annulus 136.

Figure 5A:
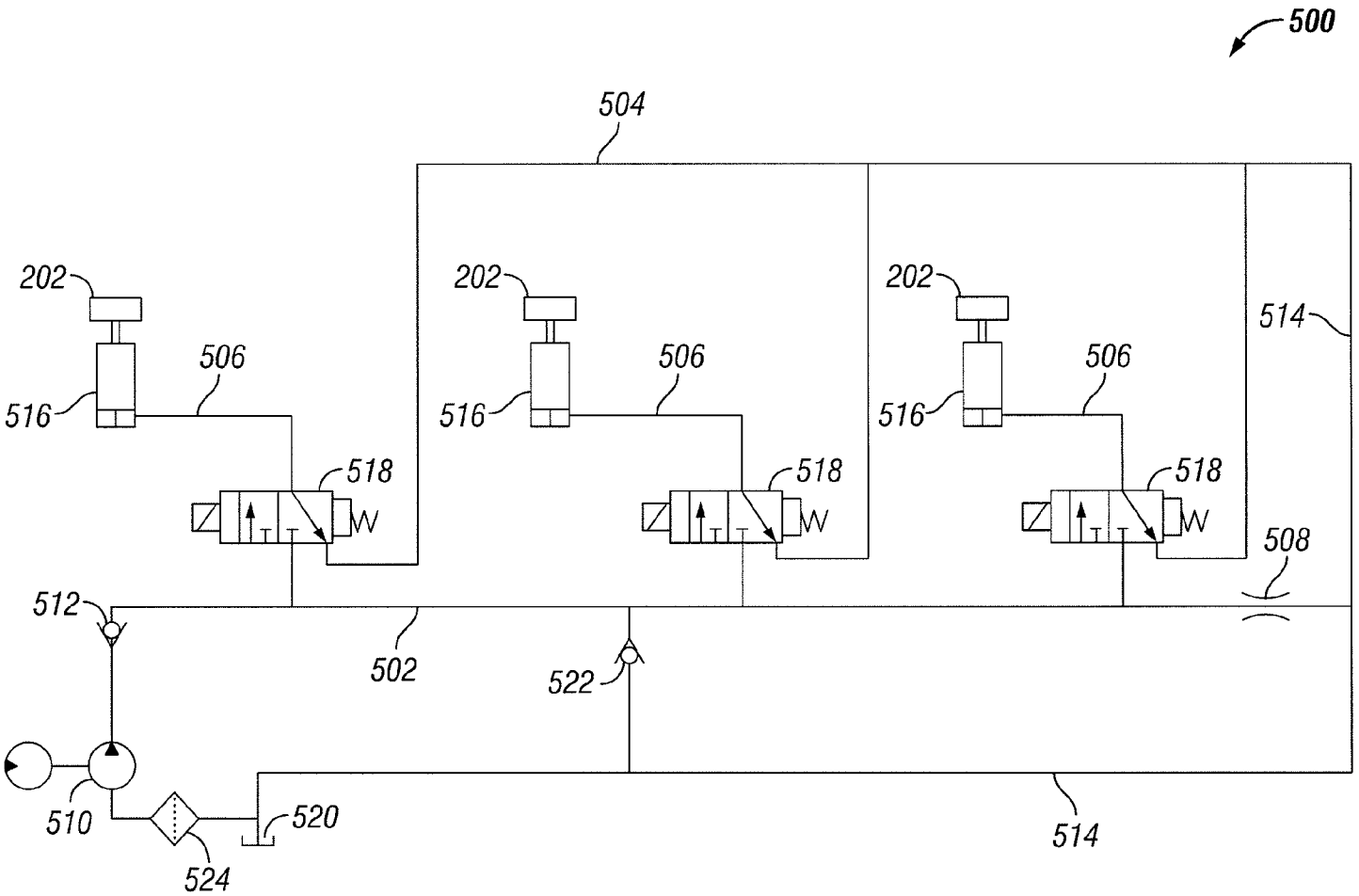
FIG. 5A depicts an example of an internal hydraulic system of the rotary steerable tool, according to one or more aspects of the present disclosure.

FIG. 5A depicts an embodiment of an internal hydraulic system 500 that can be used with the rotary steerable tool 128 using hydraulic actuation to move, actuate or otherwise transition the extendable members 202 of an extendable member assembly 130, in accordance with one or more aspects of the present disclosure. In one or more embodiments, the hydraulic system 500 is contained within the rotary steerable tool 128 (for example, not open to an annulus) and may utilize a general hydraulic fluid. The hydraulic system 500 includes a high pressure line 502 and a low pressure line 504. FIG. 5A illustrates a plurality of 3 way-2 position valves 518 that utilize differential hydraulic pressure between the high pressure line 502 and low pressure line 504. The high pressure line 502 is coupled to one or more electrically actuated valves 518. Each electric valve 518 is also coupled to a hydraulic piston line 506, and the low pressure line 504. Generally, each hydraulic piston lines 506 is associated with a piston 516, an extendable member 202 or both on the rotary steerable tool 128. For example, for each hydraulic piston line 506 a corresponding piston 510, extendable member 202 or both is utilized. The electrically actuated valves 518 separate the high pressure line 502 from the hydraulic piston lines 506, thereby separating the high pressure line 502 from the pistons 516. The electrically actuated valves 518 also separate the hydraulic piston lines 506 from the low pressure line 504, thereby separating the pistons 516 from the low pressure line 504.

The electrically actuated valves 518 can be individually controlled to couple or decouple the high pressure line 502 and each of the hydraulic piston lines 506. In one or more embodiments, when an electrically actuated valve 518 is actuated, the high pressure line is in fluid communication with the respective hydraulic piston line 506 and the respective piston 516. The pressure differential between the low pressure line 504 and the high pressure line 502 pushes a hydraulic fluid through the respective hydraulic piston line 506, thereby actuating the piston 516. For example, the hydraulic fluid is a lubricating clean hydraulic fluid that operates in a self-contained manner independently of the fluid 240. Actuation of the piston 516 causes extendable member extension or another protrusion to extend outwardly from the rotary steerable tool 128, applying a force on the borehole 116, thereby changing the drilling direction. When an electrically actuated valve 518 is deactivated, the respective piston 516 is isolated from the high pressure line 502, and the piston 516 is in fluid communication with the low pressure line 504, allowing the piston 516 to retract and drain fluid through the low pressure line 504 to the return line 514.

Figure 5B:
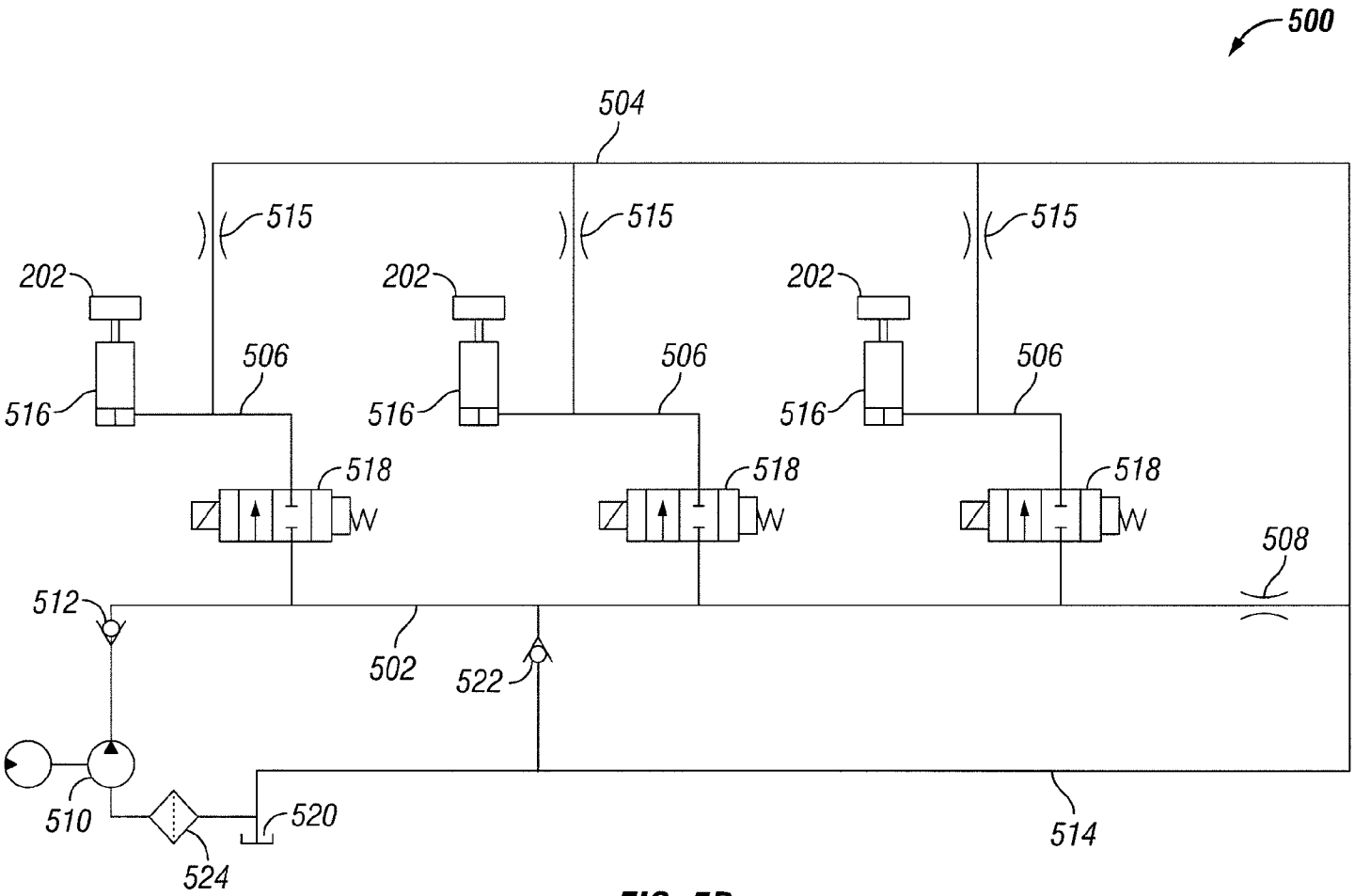
FIG. 5B depicts another example of an internal hydraulic system of the rotary steerable tool, according to one or more aspects of the present disclosure.

In one or more embodiments, the hydraulic system 500 is contained within the rotary steerable tool 128 (for example, not open to an annulus) and may utilize a general hydraulic fluid. The hydraulic system 500 includes a high pressure line 502 and a low pressure line 504. FIG. 5B comprises a plurality of 2 way-2 position valves that utilize differential hydraulic pressure between the high pressure line 502 and low pressure line 504. The high pressure line 502 is also coupled to one or more electrically actuated valves 518. Each electric valve 518 is also coupled to a hydraulic piston line 506 and the low pressure line 504. Generally, each hydraulic piston line 506 is associated with a piston 516, an extendable member 202 or both on the rotary steerable tool 128. For example, for each hydraulic piston line 506 a corresponding piston 516, extendable member 202 or both is utilized. The electrically actuated valves 518 separate the high pressure line 502 from the hydraulic extendable member lines 506, thereby separating the high pressure line 502 from the pistons 516 and the low pressure line 504. In one or more embodiments, a check valve or overpressure protection 522 may be coupled at a first end to high pressure line 502 and at a second end to return line 514.

The electrically actuated valves 518 can be individually controlled to couple or decouple the high pressure line 502 and each of the hydraulic piston lines 506. In one or more embodiments, when an electrically actuated valve 518 is actuated, the high pressure line is in fluid communication with the respective hydraulic piston line 506, its respective piston 516, and the low pressure line 504. The pressure differential between the low pressure line 504 and the high pressure line 502 pushes hydraulic fluid through the respective hydraulic piston line 506, thereby actuating the piston 516. Actuation of the piston 516 causes extendable member extension or another protrusion to extend outwardly from the rotary steerable tool 128, applying a force on the wellbore, thereby changing the drilling direction. It should be noted that some volume of fluid is flowing to the low pressure line 504 and that sufficient restriction 515 is necessary to maintain sufficient pressure differential, between the high pressure line 502 and low pressure line 504. When an electrically actuated valve 518 is deactivated, the respective piston 516 is isolated from the high pressure line 502, and the piston 516 is in fluid communication with the low pressure line 504, allowing the piston 516 to retract and drain fluid through the low pressure line 504 to the return line 514.

The internal hydraulic system 500 further includes a pump 510 and a reservoir 520 for the hydraulic fluid. The pump 510 draws hydraulic fluid from the reservoir 520 and circulates the hydraulic fluid. In one or more embodiments, the internal hydraulic system 500 includes a return line 514 coupled to the low pressure line 504 through which hydraulic fluid is circulated back to the reservoir 520. In one or more embodiments, a filter 524 may couple to the reservoir 520 and the pump 510 to remove large particulates from the fluid flowing from the reservoir 520 to prevent clogging or jamming of the pump 510 or any other component. In one or more embodiments, a filter 524 is not utilized such that reservoir 520 couples to the pump 510 without first being coupled to the filter 524. High pressure line 502 may also be coupled to the return line 514 such that the hydraulic fluid can continue to circulate when none of the electrically actuated valves 518 are actuated and the high pressure line 502 is not in communication with the low pressure line 504. In one or more embodiments, the high pressure line 502 and the return line 514 are separated by a flow restrictor 508 which restricts the flow between the high pressure line 502 and the return line 514, thereby maintaining a relatively higher pressure in the high pressure line 502. The high pressure line 502 may also include a check valve 512 configured to prevent back flow. In one or more embodiments, a check valve or overpressure protection 522 may be coupled at a first end to high pressure line 502 and at a second end to return line 514.

Figure 6:
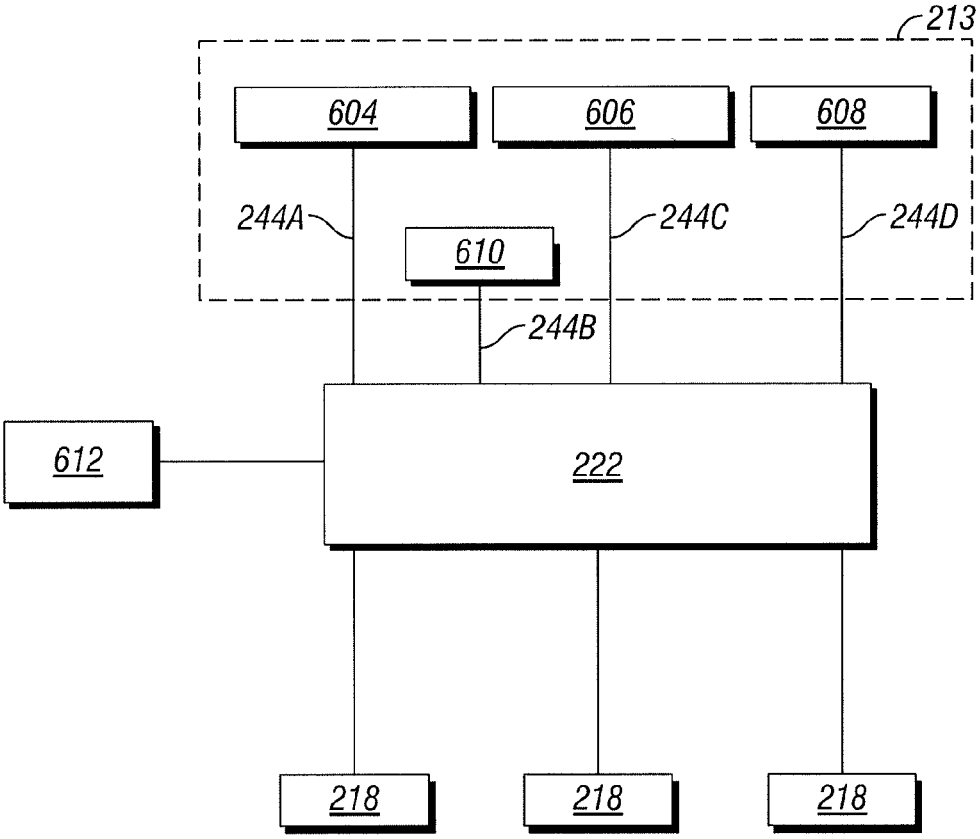
FIG. 6 depicts a block diagram of a rotary steerable system with an extendable member diagnostic assembly, according to one or more aspects of the present disclosure.

FIG. 6 depicts a block diagram of the geolocation device 213, in accordance with one or more aspects of the present disclosure. The geolocation device 213 may comprise a plurality of sensors, including, but not limited to, one or more directional sensors such as one or more accelerometers 604, one or more magnetometers 606, and one or more gyroscopes 608, and any one or more other sensors for determining an azimuth or toolface angle of the drill bit 114 to a reference direction (for example, magnetic north), inclination or angular orientation. In one or more embodiments, geolocation device 213 may comprise one or more sensors 610, including, but not limited to one or more temperature sensors, one or more magnetic field sensors, and one or more RPM sensors. The geolocation device 213 may include any number of sensors 604, 606, 608 and 610 and in any combination. Based on the azimuth and a desired drilling direction or drilling path, the rotary steerable tool 128 determines a suitable control scheme to steer the tool string 126 and drill bit 114 in the desired direction, thereby creating a directional borehole 116. The geolocation device 213 utilizes the directional sensors to provide directional geostationary reference measurements, such as rotary steerable tool inclination, azimuth or heading direction, rotation speed and angular orientation relative to these geostationary fields, for example, earth's gravity, earth's magnetic field or earth's rotational spin axis, to the controller 222 via pathway 244 for steering control of the rotary steerable tool 128 while the geolocation device 213 is also in rotation with the rotary steerable tool 128, without the need for a physically geostationary component. Accelerometers 604, magnetometers 606, gyroscopes 608, sensors 610 are communicatively coupled to the processor 602 via pathways 244A, 244C, 244D and 244B, respectively. In one or more embodiments, the directional sensors may be embedded, disposed or positioned at any location on the rotary steerable tool 128 and may be programmed or controlled to take respective measurements and transmit the measurements to the controller 222 in real time.

The controller 222 is configured to control the extendable members 202 through selective actuation of one or more valves 206 according to the measurements made by any one or more sensors discussed herein as well as a profile of the drilling operation, thereby controlling the drilling direction of the drill bit 114. The profile of the drilling operation may include information such as the location of the drilling target, type of formation, and other parameters regarding the specific drilling operation. As the rotary steerable tool 128 rotates, any one or more of the sensors discussed herein (for example, sensors 216, sensor 230, pressure sensor 220, accelerometers 604, magnetometers 606, and gyroscopes 608) continuously communicate or transmit one or more measurements to the controller 222 while rotating with the rotary steerable tool 128. The processor 602 uses the measurements to continuously track the position of the rotary steerable tool 128 with respect to the target drilling direction in real time. From this the controller 222 can determine which direction to direct the drill bit 114. Since the location of the extendable members 202 are fixed with respect to the rotary steerable tool 128, the location of the extendable members 202 can be easily derived from the location of the rotary steerable tool 128. The controller 222 can then determine when to actuate the extendable members 202 to direct the drill bit 114 in the desired or predetermined direction. Each of the extendable members 202 on the rotary steerable tool 128 can be actuated independently, in any combination, and at any time interval, which allows for agile, fully three dimensional control of the direction of the drill bit 114. The directional control may be relative to gravity toolface, magnetic toolface, or gyro toolface.

In one or more embodiments, if the drill bit 114 is required to be directed towards high side (0 degree toolface angle), then the extendable members 202 must extend and apply force against the borehole 116 at the 180 degree location of the rotary steerable tool 128. An extendable member 202 is actuated when it rotates into the 180 degree location and retracts when it rotates out of the 180 degree location. In one or more embodiments, each extendable member 202 is actuated as it rotates into the 180 degree location. Frequency of extendable member 202 extensions may depend on the speed of rotation of the rotary steerable tool 128 and the desired or predetermined rate of direction change. For example, if the rotary steerable tool 128 is rotating at a relatively high speed, an extendable member 202 may only be actuated every other rotation. Similarly, if the desired rate of direction change of the rotary steerable tool 128 is high, the extendable member 202 may be actuated at a higher frequency than if the desired rate of direction change were lower. Such parameters can be controlled by the controller 222 according to the profile of the drilling operation.

The controller 222 may be communicatively coupled to a control center 612 such that the controller 222 is in communication with control center 612. The control center 612 may comprise one or more information handling systems, for example, one or more information handling systems 700 of FIG. 7, and may communicate or transmit instructions or information to the controller 222 such as the information related to the profile of the drilling operation, for example, location of the drilling target, rate of direction change, and the like. In one or more embodiments, the control center 612 may receive spontaneous control commands from an operator which are relayed as processor-readable commands to the controller 222. In one or more embodiments, the control center 612 sends preprogrammed commands to the controller 222 set according to the profile of the drilling operation. In one or more embodiments, the geolocation device 213, the controller 222 or any other component of the rotary steerable tool 128 may receive power from a power source. Examples of power sources include batteries, mud generators, among others. The power supply actually used in a specific application can be chosen based on performance requirements and available resources.

Figure 7:
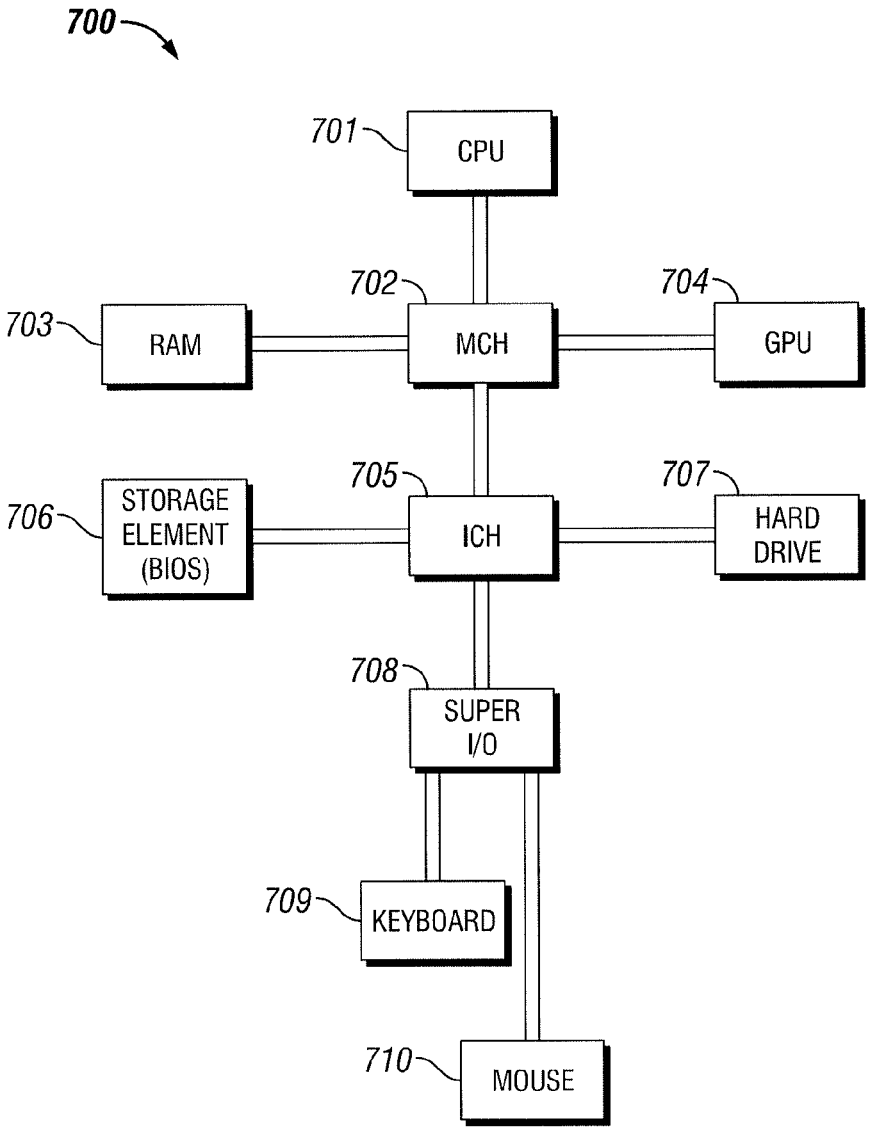
FIG. 7 depicts an example information handling system, according to one or more aspects of the present disclosure.

FIG. 7 is a diagram illustrating an example information handling system 700, according to one or more aspects of the present disclosure. The controller 222 may take a form similar to the information handling system 700. A processor or central processing unit (CPU) 701 of the information handling system 700 is communicatively coupled to a memory controller hub (MCH) or north bridge 702. The processor 701 may include, for example a microprocessor, microcontroller, digital signal processor (DSP), application specific integrated circuit (ASIC), or any other digital or analog circuitry configured to interpret and/or execute program instructions and/or process data. Processor 701 may be configured to interpret and/or execute program instructions or other data retrieved and stored in any memory such as memory 703 or hard drive 707. Program instructions or other data may constitute portions of a software or application for carrying out one or more methods described herein. Memory 703 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 403 for execution by processor 701.

Modifications, additions, or omissions may be made to FIG. 7 without departing from the scope of the present disclosure. For example, FIG. 7 shows a particular configuration of components of information handling system 700. However, any suitable configurations of components may be used. For example, components of information handling system 700 may be implemented either as physical or logical components. Furthermore, in some embodiments, functionality associated with components of information handling system 700 may be implemented in special purpose circuits or components. In other embodiments, functionality associated with components of information handling system 700 may be implemented in configurable general purpose circuit or components. For example, components of information handling system 700 may be implemented by configured computer program instructions.

Memory controller hub 702 may include a memory controller for directing information to or from various system memory components within the information handling system 700, such as memory 703, storage element 706, and hard drive 707. The memory controller hub 702 may be coupled to memory 703 and a graphics processing unit (GPU) 704. Memory controller hub 702 may also be coupled to an I/O controller hub (ICH) or south bridge 705. I/O controller hub 705 is coupled to storage elements of the information handling system 700, including a storage element 706, which may comprise a flash ROM that includes a basic input/output system (BIOS) of the computer system. I/O controller hub 705 is also coupled to the hard drive 707 of the information handling system 700. I/O controller hub 705 may also be coupled to a Super I/O chip 708, which is itself coupled to several of the I/O ports of the computer system, including keyboard 709 and mouse 710.

Figure 8:
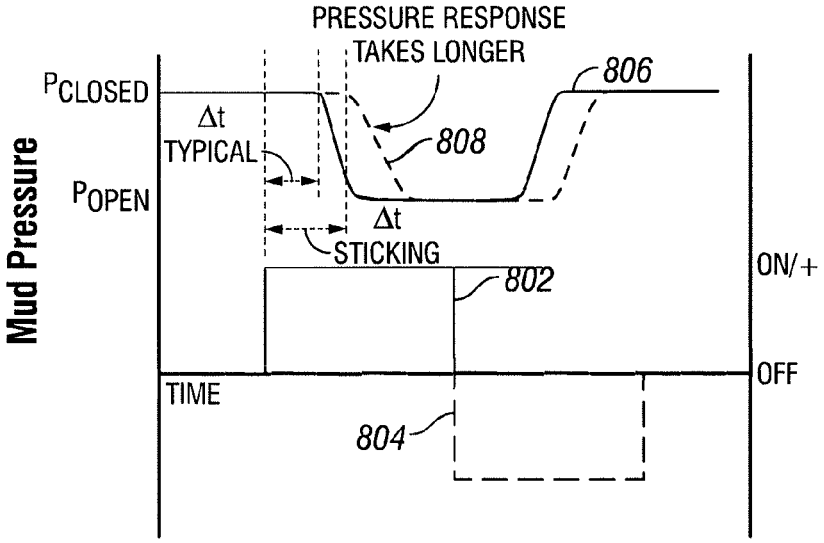
FIG. 8 depicts a graph of performance deterioration of a component of an extendable member diagnostic assembly, according to one or more aspects of the present disclosure.

FIG. 8 depicts a graph of performance deterioration of a component of an extendable member diagnostic assembly 250, according to one or more aspects of the present disclosure. Degradation of performance of any one or more components of the rotary steerable tool 128, for example, the actuator 218, the valve 206 or both will affect actuation time of the extendable member 202. The amount of time the actuator 218 or the valve 206 takes to transition between position or states can change as the respective component degrades. The degradation of these components in turn affects flow characteristics of the fluid 240. For example, during operation, a small delay ($\Delta t$) between actuation of a component and pressure response in the flowbore 201 is expected and generally known due to testing, ratings or industry specifications associated with the component. For example, residue or debris accumulated on the actuator 218 may cause the actuator 218 to stick which will increase $\Delta t$ as the actuator 218 will be slower in responding to the control signal from the controller 222 which translates in the valve 206 taking longer to transition states. As illustrated in FIG. 8, mud pressure of pressure of fluid 240 is plotted versus time. Line 802 represents the time when actuator 218 is in an ON state, or when a positive current or voltage is applied, and line 804 represents the time when actuator 218 is in an OFF (state), or when a reverse current or voltage is applied. $P_{open}$ denotes the state of the valve 206 is open and $P_{closed}$ denotes the state of the valve 206 is closed. Line 806 illustrates a typical performance of valve 206 whereas Line 808 illustrates performance of valve 206 due to sticking of actuator 218. As illustrated, the typical delay time $\Delta t_{typical}$ increases to $\Delta t_{sticking}$ due to the sticking of the actuator 218 indicating a decrease in performance of the actuator 218.

Figure 9:
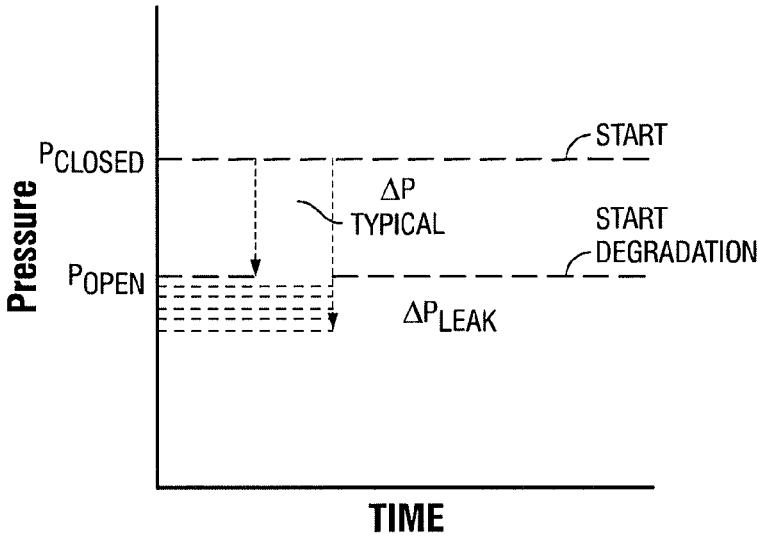
FIG. 9 depicts a graph of performance deterioration of a component of an extendable member diagnostic assembly, according to one or more aspects of the present disclosure.

FIG. 9 depicts a graph of performance deterioration of a component of an extendable member diagnostic assembly 250, according to one or more aspects of the present disclosure. As illustrated in FIG. 9, valve 206 may have a rated or known performance such that the different in pressure (pressure $P_{Open}$ to transition state to open position or state and $P_{Closed}$ to transition state to closed position or state) to transition between positions or states, open position or state and closed position or state, is $\Delta P_{typical}$. As the valve 206 degrades, erodes or otherwise experiences a decline in performance, the steady state pressure to transition from, for example, a closed state to an open position or state will increase to $\Delta P_{leak}$. Degradation is determined once the change in pressure required to transition states of the valve 206 exceeds $\Delta P_{typical}$.

Figure 10:
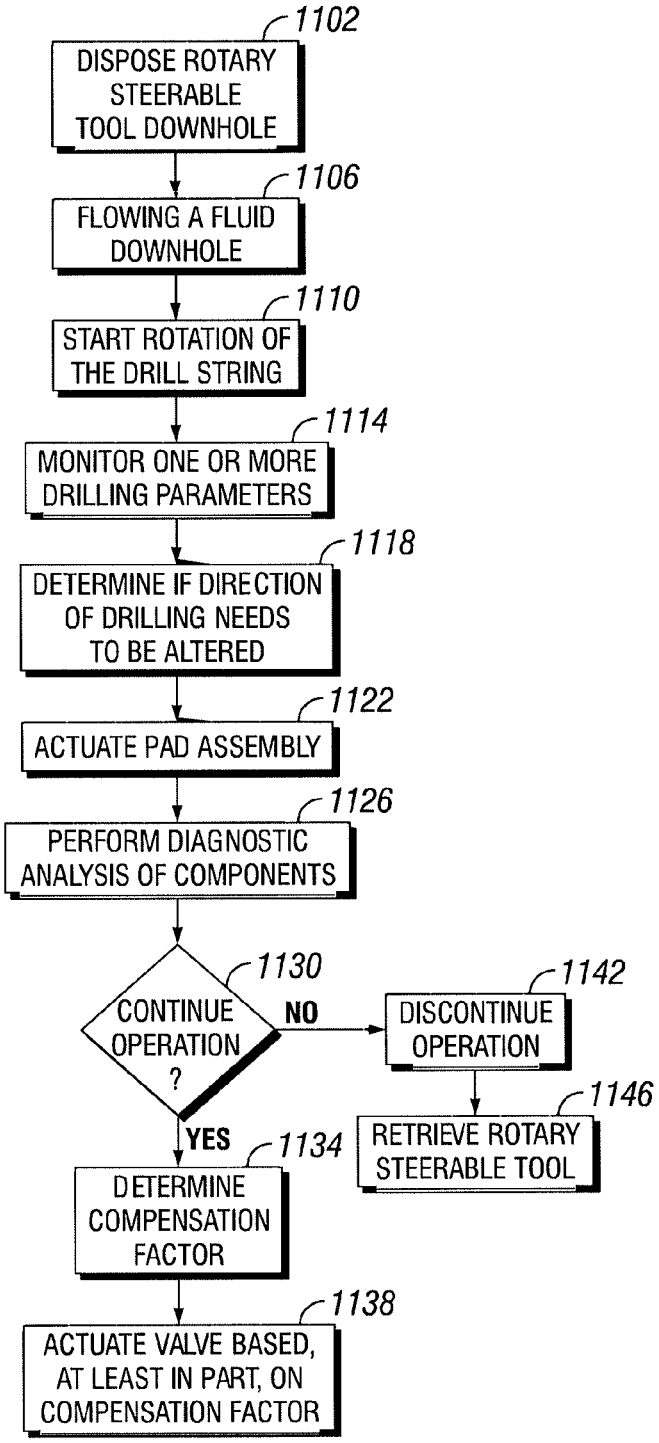
FIG. 10 depicts a flowchart of an example method for using an extendable member diagnostic assembly, according to one or more aspect of the present disclosure.

FIG. 10 depicts a flowchart of an example method for using an extendable member diagnostic assembly, according to one or more aspect of the present disclosure. At step 1102, an operation begins, for example, a hydrocarbon exploration operation, recovery operation, or both, by disposing or positioning a rotary steerable tool 128 comprising an extendable member assembly 130 in a borehole 116, for example, as illustrated in FIG. 1. At step 1106, a fluid 240 is flowed or pumped downhole through a flowbore 201 of the rotary steerable tool 128, for example, a drilling fluid, and at step 1110 rotation of the drill string 108 and actuation of the drill bit 114 is started based on the flow of the fluid 240.

At step 1114, one or more drilling parameters are monitored. The one or more drilling parameters may comprise drilling direction, position of the actuator 218, valve 206 or both, pressure of fluid 240, flow rate of fluid 240, temperature, orientation, angular velocity or rotation, weight on bit, torque on bit, tool bend or bending moment, bend direction, vibration (for example, axial, radial or angular vibration), steering duty cycle, extendable member extension, retraction time, steering mode (drilling a straight borehole or a curved borehole) or any combination thereof. Based, at least in part, on the monitored drilling parameters, at step 1118 a determination is made as to altering direction of drilling. For example, if the borehole 116 is trending in a direction not consistent with the operation, the drilling string 126, the drill bit 114 or both may be adjusted to correct the direction of drilling.

In one or more embodiments, if direction of drilling needs to be altered, an extendable member assembly 130 may be actuated at step 1122 to extend an extendable member 202 so that extendable member 202 contacts the borehole 116 at an angle and for a period of time sufficient to adjust or alter the direction of drilling. At step 1126 diagnostic analysis is performed on or a determination of performance is made of one or more components of the extendable member assembly 130. For example, in one or more embodiments extendable member assembly 130 comprises an extendable member diagnostic assembly 250. For example, a controller 222 of the extendable member diagnostic assembly 250 receives one or more measurements related to one or more operational characteristics of any one or more components of the extendable member diagnostic assembly, for example, one or more components of the extendable member assembly 130. The one or more operational characteristics may comprise but are not limited to, pressure associated with the fluid 240 pumped downhole as measured by a pressure sensor 220, position or status of actuator 218, valve 206 or both as indicated by sensor 230, temperature as indicated by sensor 254, type of fluid 240 or any other characteristic mud turbine speed used to power a rotary steerable system, pressure drop measurement across the a lower restrictor above the drill bit 114, current drawn by the actuators 218 when on or off, voltage across the actuators 218 when on or off, pressure sensed in any of the flow channels leading to or from the actuators 218 or piston chamber 212, linear movement sensors measuring the piston 213 position, speed of movement and continuity of movement (for example, smooth movement or non-linear movement). Performance of one or more components of the extendable member assembly 130 is determined based on the one or more operational characteristics. Degradation may occur or performance may be inhibited or decreased based on one or more factors including, but not limited to, erosion of a component, for example, valve 206, (such as wear and tear or exposure to environmental conditions of the valve, for example, an electrical winding of the actuator 218 may become damaged through overheating and not able to carry as much current), sticking of the valve 206 due to stiction or friction (such as contamination along the shaft of the actuator 218, loss of seal of the valve 206 which may cause the valve 206 to become contaminated with the fluid 240, amount of power, voltage, current or any combination thereof to actuate actuator 218, amount of time to transition actuator 218, valve 206 or both between positions or states or positions, or any other downhole condition attributable to stiction or friction or any combination thereof), thermal expansion, or any combination thereof. The one or more operational characteristics may be indicative of any one or more of the factors.

Figure 11:
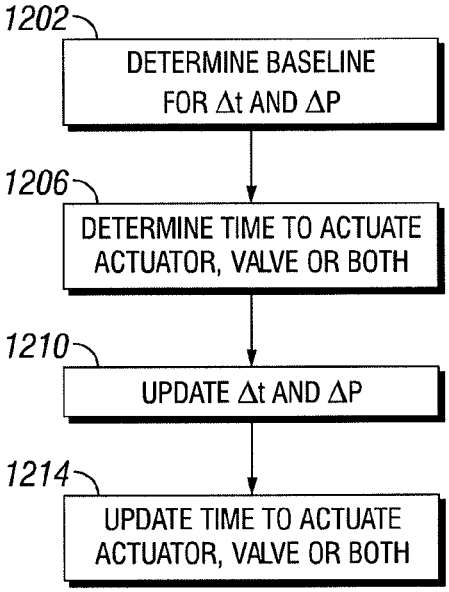
FIG. 11 depicts a flowchart of an example method for using an extendable member diagnostic assembly, according to one or more aspect of the present disclosure.

For example, as illustrated in FIG. 11, a baseline for a model of pressure over time with valve 206 closed and pressure with valve 206 open is established and normalized at step 1202. The expected pressure to maintain valve 206 in a closed position or state and valve 206 in an open position or state is determined as function of temperature, for example, as illustrated in FIG. 8 and FIG. 9, such that a baseline $\Delta t$ (time required to transition valve 206 between positions or states) and a baseline $\Delta P$ (pressure required to transition valve 206 between positions or states) are known prior to disposing or positioning the extendable member assembly 130 downhole. At step 1206, the controller 222 monitors the time to transition the actuator 218, the valve 206 or both between positions or states. For example, controller 222 receives one or more measurements associated with one or more operational characteristics of one or more components of the extendable member assembly 130 such as one or more measurements indicative of the transition or actuation time of valve 206 from sensor 230, amount of voltage, current, power or any combination thereof required to actuate or transition the actuator 218 from sensor 246, temperature from sensor 254, pressure from pressure sensor 220, any other parameter, or any combination thereof. The baseline $\Delta t$ and baseline $\Delta P$ are updated at step 1210 based on the one or more measurements. At step 1214, the time to actuate actuator 218, valve 206 or both is updated based on the updated $\Delta t$ and $\Delta P$.

Returning to step 1126, once diagnostic analysis is performed, it is determined at step 1130 whether an operation should be continued. For example, the updated $\Delta t$, $\Delta P$ or both may indicate that the extendable member assembly 130 is not performing at a desired level. In one or more embodiments, the performance of the actuator 218, the valve 206 or both may be determined by comparing the updated $\Delta t$, $\Delta P$, or both to a corresponding threshold or range. For example, the updated $\Delta t$ may be compared to a time threshold or a time range and ΔP may be compared to a pressure threshold or a pressure range to determine performance of one or more components of the extendable member diagnostic assembly 250, for example, any one or more components of the extendable member assembly 130 such as the valve 206. In one or more embodiments, the updated Δt is compared to a time threshold, the updated ΔP is compared to a pressure threshold or both. If the updated Δt does not meet a time threshold, the updated ΔP does not meet pressure threshold, or any combination therefore, then at step 1142 the operation (for example, a drilling operation) is altered. For example, drilling is discontinued and at step 1146 the rotary steerable tool 128 is retrieved. Once the rotary steerable tool 128 is retrieved, the extendable member assembly 130 may be replaced, repaired or otherwise adjusted or altered to allow for continuation of the operation or the operation may cease. In one or more embodiments, comparison to a threshold may require a determination that a value is at the threshold, exceeds the threshold, is below the threshold, at or above the threshold, or at or below the threshold. In one or more embodiments, the threshold is a range where comparison to the range may require a determination that a value is within the range, outside the range, within including the endpoints of the range or outside including the endpoints of the range.

If it is determined that operation should be continued, for example based on a comparison of Δt, ΔP or both to a corresponding threshold, then at step 1134 the drilling may be altered based on a compensation factor that is determined. For example, the performance of any one or more components of the extendable member diagnostic assembly may be based on compensation factor. For example, a valve compensation factor of valve 206, an actuator compensation factor of actuator 218, or both may be determined by controller 222. The valve compensation factor may be based, at least in part, on the updated Δt, ΔP, or both, pressure of fluid 240, temperature, or any other factor. The controller 222 may adjust actuation of the actuator 218 to transition the valve 206 based, at least in part, on the valve compensation factor. For example, the valve compensation factor may be indicative of valve lag time. The actuator compensation factor may be based, at least in part, on power, current or voltage required to actuate the actuator 218. For example, controller 222 may determine actuator lag time based, at least in part, on one or more measurements from sensor 246. For example, the actuator compensation factor may be indicative of actuator lag time. The controller 222 may adjust the actuation of actuator 218 based, at least in part, on the actuator compensation factor. For example, power to the actuator 218 may be increased to actuate the valve 206 at a desired speed to clear a suspected obstruction. In one or more embodiments, the valve 206 may be cycled repeatedly and rapidly to clear a suspected obstruction. In one or more embodiments, a valve 206 may be transitioned to an "ON" state or an "OFF" state and held at that state and any one or more remaining valves may be utilized for steering.

At step 1138, the valve 206 is actuated or transitioned based, at least in part, on the valve compensation factor, the actuator compensation factor or both. For example, if it is determined that the drilling operation should be altered such that the drill bit 114 direction should be altered or adjusted, the controller 222 communicates or transmits a signal to actuate or transition the actuator 218. The actuator 218 is transitioned or actuated based, at least in part, on any one or more of the actuator compensation factor, temperature, pressure or any combination thereof. Timing of the actuation or transition of actuator 218 is based, at least in part, on the valve compensation factor. For example, as the updated Δt, updated Δt, ΔP, or both increases the valve 206 may require a longer time to transition between positions or states which requires that the actuator 218 may need to be actuated or transitioned earlier to compensate for this valve lag time. In another example, the actuator 218 may have an actuator lag time such that the actuator 218 requires a longer time to transition or actuate which requires that the actuator 218 be transitioned or actuated earlier to compensate for this actuator lag time.

To control direction of the drill bit 114, the extendable member 202 must be extended and retracted during intervals of time as the drill string 108 rotates. The timing and duration of the intervals may be based on one or more operational characteristics of one or more components of the extendable member assembly 130. The controller 222 receives one or more measurements associated with one or more operational characteristics of one or more components of the extendable member assembly 130. The controller 222 determines the appropriate timing to actuate or transition the actuator 218 to cause the valve 206 to transition to an open position or state to allow fluid 240 to flow through the valve 206 and actuate a piston 213 to extend an extendable member 202 via piston rod 215 for a duration or period of time and to actuate or transition the actuator 218 to cause the valve 206 to transition to a closed state to prevent fluid 240 from flowing through the valve 206 such that the piston 213, piston rod 215 and the extendable member 202, and any combination thereof are retracted based on the operational characteristics of the one or more components of the extendable member assembly 130.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

In one or more embodiments, a rotary steerable tool comprising a tool body with a flowbore through the tool body, an extendable member, a valve coupled to the extendable member, an actuator coupled to the valve, wherein the actuator selectively actuates the valve to transition the valve between states to control flow of a fluid from the flowbore via a supply path through the valve, a sensor coupled to the valve, wherein the sensor detects a position of the valve, and a controller communicatively coupled to the actuator and the sensor, wherein the controller receives one or more measurements from the sensor, and wherein the controller actuates the actuator based, at least in part, on the one or more measurements. In one or more embodiments, rotary steerable tool further comprises a piston coupled between the valve and the extendable member and wherein flow of the fluid through the supply path when the valve is in the open position or state increases pressure in an actuation path to actuate the piston. In one or more embodiments, the rotary steerable tool further comprises, a bleed path, wherein the bleed path couples the supply path via the valve to an annulus of the wellbore, and wherein when the valve is in the open state the actuation path is closed to the bleed path so that differential pressure between the flowbore and the annulus is applied to the piston. In one or more embodiments, the rotary steerable tool further comprises an electronics module disposed in the flowbore and communicatively coupled to the controller, wherein the electronics module comprises a flow meter sensor. In one or more embodiments, the rotary steerable tool further comprises a turbine disposed in the flowbore and communicatively coupled to the electronics module. In one or more embodiments, the rotary steerable tool further comprises a geolocation device disposed in the flowbore and communicatively coupled to the controller, wherein the geolocation device senses positioning of the rotary steerable tool. In one or more embodiments, the controller comprises one or more of a voltage sensor and a current sensor.

In one or more embodiments, a method of operation of a rotary steerable tool comprises receiving one or more measurements from an extendable member diagnostic assembly of the rotary steerable tool disposed in a borehole, determining performance of one or more components of an extendable member assembly of the rotary steerable tool coupled to the extendable member diagnostic assembly based on the one or more measurements, and altering operation of the one or more components based, at least in part, on the determined performance. In one or more embodiments, determining the performance of the one or more components is based on one or more operational characteristics of one or more components of the extendable member diagnostic assembly. In one or more embodiments, determining the performance of the one or more components comprises determining a performance of a valve coupled to an extendable member of the extendable member assembly, and altering a direction of drilling by actuating the valve based on the determined performed of the valve. In one or more embodiments, the one or more operational characteristics are indicative of one or more erosion of the valve coupled to the extendable member of the extendable member assembly, sticking of the valve, loss of seal of the valve and transition time of the valve. In one or more embodiments, the method of operation of a rotary steerable tool further comprises updating one or more of a baseline time required to transition the valve between states based on the one or more measurements and a baseline pressure required to transition the valve between states based on the one or more measurements and wherein the determined performance is based on one or more of the updated baseline time and the updated baseline pressure. In one or more embodiments, the method of operation of a rotary steerable tool further comprises comparing the updated baseline time to a time threshold and altering drilling based on the comparison. The method of operation of a rotary steerable tool further comprises comparing the updated baseline pressure to a pressure threshold and altering drilling based on the comparison. In one or more embodiments, the method of operation of a rotary steerable tool further comprises determining a compensation factor based on one or more of the updated baseline time and the updated baseline pressure and wherein altering operation of the one or more components is based, at least in part, on the compensation factor.

In one or more embodiments, an extendable member diagnostics assembly comprises a valve coupled to an extendable member, an actuator coupled to the valve, wherein the actuator actuates the valve to an open position to extend the extendable member or to a closed position or state to retract the extendable member, a supply path fluidically coupled to the valve, wherein the supply path allows a fluid to flow from a flowbore to the valve, wherein actuation of the valve to the open position allows the fluid to flow through the valve, a sensor coupled to the valve, wherein the sensor detects a position of the valve, and a controller communicatively coupled to the actuator and the sensor, wherein the controller receives one or more first measurements from the sensor, and wherein the controller actuates the actuator based, at least in part on, the one or more measurements. In one or more embodiments, the extendable member diagnostics assembly further comprises a pressure sensor communicatively coupled to the controller. In one or more embodiments, the extendable member diagnostics assembly further comprises one or more of a voltage sensor and a current sensor. In one or more embodiments, the extendable member diagnostics assembly further comprises one or more of a temperature sensor and an orientation sensor.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A rotary steerable tool, comprising:

a tool body with a flowbore through the tool body;

an extendable member;

a valve coupled to the extendable member;

an actuator coupled to the valve to selectively actuate the valve to transition the valve between states to control flow of a fluid from the flowbore via a supply path through the valve;

a sensor coupled to the valve to detect a position of the valve; and a controller communicatively coupled to the actuator and the sensor (i) to receive one or more measurements from the sensor, and (ii) to selectively actuate the actuator based, at least in part, on the one or more measurements, wherein the one or more measurements are usable to determine performance of the valve.

2. The rotary steerable tool of claim 1, further comprising:

a piston coupled between the valve and the extendable member, wherein flow of the fluid through the supply path when the valve is in an open state increases pressure in an actuation path to actuate the piston.

3. The rotary steerable tool of claim 2, further comprising:

a bleed path to couple the supply path via the valve to an annulus of a wellbore; and wherein when the valve is in the open state the actuation path is closed to the bleed path so that differential pressure between the flowbore and the annulus is applicable to the piston.

4. The rotary steerable tool of claim 1, further comprising:

an electronics module disposed in the flowbore and communicatively coupled to the controller, wherein the electronics module comprises a flow meter sensor.

5. The rotary steerable tool of claim 4, further comprising:

a turbine disposed in the flowbore and communicatively coupled to the electronics module.

6. The rotary steerable tool of claim 1, further comprising:

a geolocation device disposed in the flowbore and communicatively coupled to the controller, wherein a position of the rotary steerable tool is sensable by the geolocation device.

7. The rotary steerable tool of claim 1, wherein the controller comprises one or more of a voltage sensor and a current sensor.

8. A method of operation of a rotary steerable tool, the method comprising:

receiving one or more measurements from an extendable member diagnostic assembly of the rotary steerable tool disposed in a borehole;

determining, based on the one or more measurements, performance of one or more components of an extendable member assembly of the rotary steerable tool coupled to the extendable member diagnostic assembly, the one or more components comprising a valve coupled to an extendable member of the extendable member assembly; and altering operation of the one or more components based, at least in part, on the determined performance.

9. The method of operation of the rotary steerable tool of claim 8, wherein determining the performance of the one or more components is based on one or more operational characteristics of one or more components of the extendable member diagnostic assembly.

10. The method of operation of the rotary steerable tool of claim 9, further comprising:

altering a direction of drilling by actuating the valve based on the determined performance of the valve.

11. The method of operation of the rotary steerable tool of claim 10, wherein the one or more operational characteristics are indicative of one or more of erosion of the valve coupled to the extendable member of the extendable member assembly, sticking of the valve, loss of seal of the valve, and transition time of the valve.

12. The method of operation of the rotary steerable tool of claim 10, further comprising:

updating one or more of a baseline time required to transition the valve between states based on the one or more measurements and a baseline pressure required to transition the valve between states based on the one or more measurements; and wherein the determined performance is based on one or more of the updated baseline time and the updated baseline pressure.

13. The method of operation of the rotary steerable tool of claim 12, further comprising:

comparing the updated baseline time to a time threshold; and altering drilling based on the comparison.

14. The method of operation of the rotary steerable tool of claim 12, further comprising:

comparing the updated baseline pressure to a pressure threshold; and altering drilling based on the comparison.

15. The method of operation of the rotary steerable tool of claim 12, further comprising:

determining a compensation factor based on one or more of the updated baseline time and the updated baseline pressure; and wherein altering operation of the one or more components is based, at least in part, on the compensation factor.

16. An extendable member diagnostics assembly, comprising:

a valve coupled to an extendable member;

an actuator coupled to the valve to actuate the valve to an open position to extend the extendable member or to a closed position to retract the extendable member;

a supply path fluidically coupled to the valve, wherein the supply path allows a fluid to flow from a flowbore to the valve, wherein actuation of the valve to the open position allows the fluid to flow through the valve;

a sensor coupled to the valve to detect a position of the valve; and a controller communicatively coupled to the actuator and the sensor (i) to receive one or more first measurements from the sensor, and (ii) to actuate the actuator based, at least in part on, the one or more measurements, wherein the one or more measurements are usable to determine performance of the valve.

17. The extendable member diagnostics assembly of claim 16, further comprising:

a piston coupled between the valve and the extendable member, wherein flow of the fluid through the supply path when the valve is in the open position increases pressure in an actuation path to actuate the piston.

18. The extendable member diagnostics assembly of claim 16, further comprising a pressure sensor communicatively coupled to the controller.

19. The extendable member diagnostics assembly of claim 16, further comprising one or more of a voltage sensor and a current sensor.

20. The extendable member diagnostics assembly of claim 16, further comprising one or more of a temperature sensor and an orientation sensor.

* * * * *